US009276322B2

(12) United States Patent
Ban et al.

(10) Patent No.: US 9,276,322 B2
(45) Date of Patent: Mar. 1, 2016

(54) ANTENNA DEVICE AND MOBILE PHONE

(75) Inventors: Yasumitsu Ban, Yokosuka (JP); Takashi Yamagajo, Yokosuka (JP); Kouji Soekawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 283 days.

(21) Appl. No.: 13/599,273

(22) Filed: Aug. 30, 2012

(65) Prior Publication Data

US 2013/0063313 A1 Mar. 14, 2013

(30) Foreign Application Priority Data

Sep. 9, 2011 (JP) ..... 2011-197582
Aug. 22, 2012 (JP) ..... 2012-183650

(51) Int. Cl.
*H01Q 1/38* (2006.01)
*H01Q 13/10* (2006.01)

(52) U.S. Cl.
CPC ..... *H01Q 13/106* (2013.01)

(58) Field of Classification Search
USPC ..... 343/700 MS, 702
See application file for complete search history.

(56) References Cited

U.S. PATENT DOCUMENTS 6,166,694 A * 12/2000 Ying ..... H01Q 1/243 343/700 MS
6,819,290 B2 * 11/2004 Hani ..... H01Q 1/243 343/700 MS
7,183,982 B2 * 2/2007 Kadambi ..... H01Q 1/243 343/700 MS
7,245,260 B2 * 7/2007 Chang ..... H01Q 1/243 343/700 MS
7,535,422 B2 * 5/2009 Liu ..... G06F 1/1616 343/700 MS
2005/0259013 A1 11/2005 Gala Gala et al.
2007/0040751 A1 2/2007 Boyle
2008/0180333 A1 * 7/2008 Martiskainen ..... H01Q 1/243 343/722
2009/0262028 A1 10/2009 Mumbru et al.
2010/0214174 A1 8/2010 Guan et al.
2010/0214714 A1 8/2010 Stethem et al.

FOREIGN PATENT DOCUMENTS

CN 1545749 11/2004
CN 1630962 6/2005
CN 200959369 10/2007
JP 2004-128660 4/2004
JP 2005-531177 10/2005
WO 2004/001894 12/2003

OTHER PUBLICATIONS

European Search Report dated Nov. 28, 2012 from corresponding European Application No. 12183173.9.
Office Action dated Apr. 21, 2014, from the corresponding Chinese Patent Application No. 201210328344.6.

(Continued)

*Primary Examiner* — Sue A Purvis
*Assistant Examiner* — Hai Tran
(74) *Attorney, Agent, or Firm* — Katten Muchin Rosenman LLP

(57) ABSTRACT

There is provided an antenna device that includes a substrate, a slot provided in the substrate so that the slot includes a cut opening that is close to an edge of the substrate and the slot includes a crooked portion, a conductor section configured to include a slit in an area of the substrate, the area being sandwiched by the slot in the crooked portion, and an antenna that is placed close to the conductor section and is side by side with a surface of the substrate.

14 Claims, 21 Drawing Sheets

(56) References Cited

OTHER PUBLICATIONS

2nd Office Action dated Aug. 8, 2014, from the corresponding Chinese Patent Application No. 201210328344.6.

Office Action dated Aug. 8, 2014, from the corresponding Chinese Patent Application No. 201210328344.6.

Decision of Rejection dated Jan. 12, 2015, from the corresponding Chinese Patent Application No. 201210328344.6, 2012.

* cited by examiner

ANTENNA DEVICE AND MOBILE PHONE

CROSS-REFERENCE TO RELATED APPLICATIONS

This application is based upon and claims the benefit of priority of the prior Japanese Patent Applications No. 2011-197582, filed on Sep. 9, 2011, and No. 2012-183650, filed on Aug. 22, 2012, the entire contents of which are incorporated herein by reference.

FIELD

The embodiments discussed herein are related to an antenna device and a mobile phone.

BACKGROUND

An inverted-L antenna or the like is becoming often used for an electronic device such as a mobile phone in order to obtain high directional gain. On the other hand, electronic devices have become thinner in recent years, so that a request to lower the height of an antenna has been increased. There is the same request when the inverted-L antenna is used, and the height of the inverted-L antenna is desired to be lowered.

Conventionally, to cope with the request for thinning electronic devices, an antenna device is proposed in which a multi-band meander-line inverted-F antenna and a slot of a substrate metal on which the antenna is set are combined. Also, a thin and broadband antenna device is provided in which a slot is provided in a substrate metal, a passive element is extended from a side of an opening of the slot, and a feeding point is provided at the opening.

Japanese National Publication of International Patent Application No. 2005-531177 and Japanese Laid-open Patent Publication No. 2004-128660 are examples of related art.

The disclosed technique is made in view of the above problems and an object of the technique is to provide an antenna device and a mobile phone which may secure a good matching condition within a small-footprint.

SUMMARY

According to an aspect of the invention, an apparatus includes a substrate, a slot provided in the substrate so that the slot includes a cut opening that is close to an edge of the substrate and the slot includes a crooked portion, a conductor section configured to include a slit in an area of the substrate, the area being sandwiched by the slot in the crooked portion, and an antenna that is placed close to the conductor section and is side by side with a surface of the substrate.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

There are following problems for the inverted-L antenna and meander-line inverted-F antenna described in the related art. If the height of the inverted-L antenna is too low, there is a risk that the inverted-L antenna is far away from a matching condition of the characteristic impedance. In this case, in order to match the characteristic impedance, it is considered to use a matching element such as a coil or a capacitor. However, when a matching element is used, the circuit scale increases and it is difficult to thin and downsize electronic devices.

Because of this, when the related art in which the meander-line inverted-F antenna and the slot are combined is used, it is difficult to further reduce the footprint of the antenna. Also, in the related art in which the passive element is extended from the side of an opening of the slot and the feeding point is provided at the opening, it is difficult to further reduce the footprint of the antenna.

Hereinafter, embodiments of an antenna device and a mobile phone disclosed in the present application will be described in detail with reference to the drawings. The embodiments described below do not limit the antenna device and the mobile phone disclosed in the present application.

First Embodiment

Figure 1:
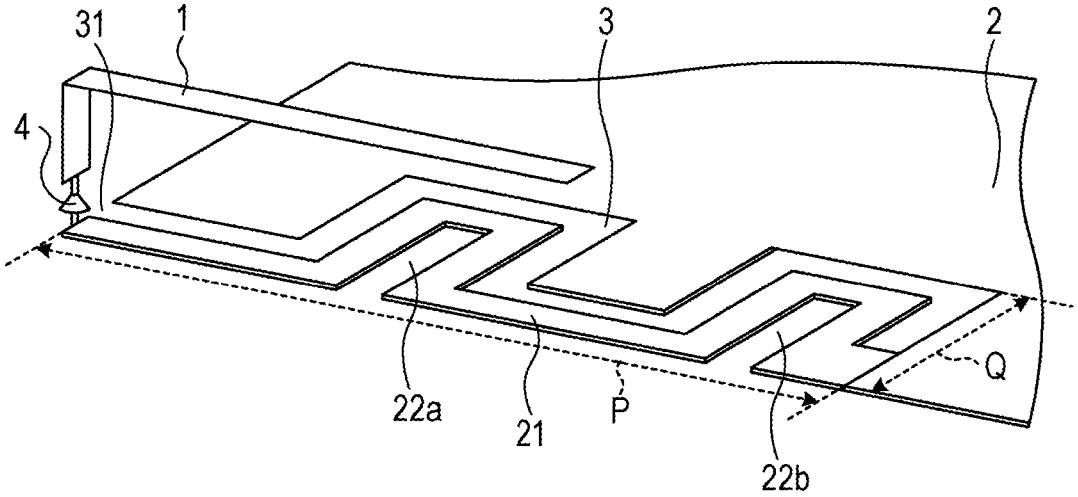
FIG. 1 is an exploded perspective view of an antenna device according to a first embodiment.

FIG. 1 is an exploded perspective view of an antenna device according to a first embodiment. As illustrated in FIG. 1, the antenna device according to the present embodiment includes an inverted-L antenna 1, a substrate metal 2, a slot 3 which is a slit provided in the substrate metal 2, and a feeding point 4. In the present embodiment, the substrate metal 2 has a plate-like shape and a rectangular shaped surface.

The slot 3 has an opening 31, which is the starting position of the slit, near an end portion of the substrate metal 2. Further, the slot 3 has a meander shape. The opening 31 corresponds to an example of a "cut opening".

The substrate metal 2 has areas on both sides of the slot 3. The substrate metal 2 has a peninsula section 21 which is a smaller area of the two areas separated by the slot 3. The peninsula section 21 corresponds to an example of a "conductor section". Further, the peninsula section 21 is provided with slits 22*a* and 22*b* from an extending edge portion. Thereby, the peninsula section 21 has a belt-shape and a meander shape.

The feeding point 4 is provided near the tip of the peninsula section 21.

The inverted-L antenna 1 is connected to the feeding point 4 and further connected near the tip of the peninsula section 21 of the substrate metal 2 through the feeding point 4. In the present embodiment, the height of the inverted-L antenna 1 from the substrate metal 2 is 3 mm. However, the size and shape of the inverted-L antenna 1 are free. The inverted-L antenna may be an inverted-F antenna.

A distance P represents the length of the long side of an area occupied by the slot 3 and the peninsula section 21 in the substrate metal 2 (hereinafter referred to as a "placing area"). In the present embodiment, the distance P is 17 mm. A distance Q represents the length of the short side of the placing area. In the present embodiment, the distance Q is 6 mm. On the other hand, when the slot 3 and the peninsula section 21 are linear, to obtain the same resonant frequency as that in the present embodiment, the length of the long side of the placing area has to be 26.4 mm. In other words, the slot 3 and the peninsula section 21 have a meander shape, so that it is possible to shorten the long side of the placing area. Therefore, it does not have to secure a long area as the placing area, so that the entire antenna device may be compact.

Figure 2:
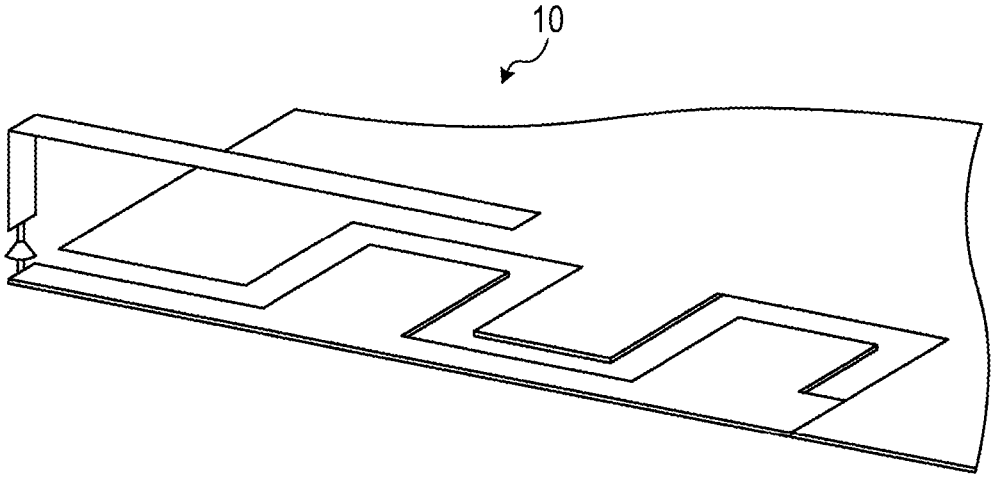
FIG. 2 is an exploded perspective view of an antenna device for comparing a resonant frequency and matching with those in the first embodiment.

FIG. 2 is an exploded perspective view of an antenna device for comparing the resonant frequency and matching with those in the first embodiment. An antenna device 10 of FIG. 2 has a configuration which includes a slot 3 having the same shape as that of the first embodiment and in which no slit is provided in a peninsula section 21. A fine-tuning to have the same resonant frequency as that of the first embodiment is not performed on the antenna device 10, so that other values of the antenna device 10 are the same as those of the first embodiment.

Figure 3:
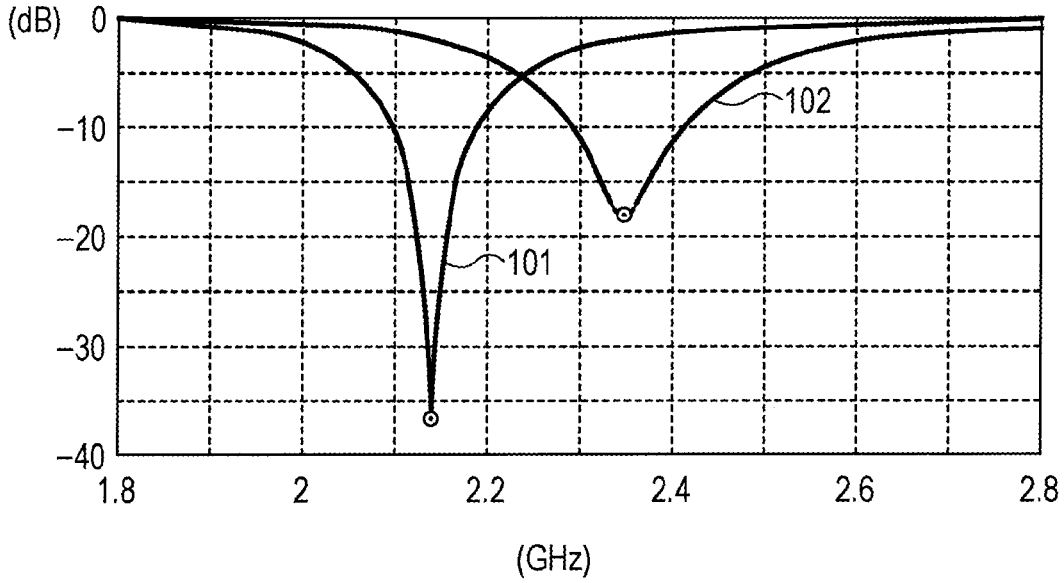
FIG. 3 is a diagram for explaining resonant frequencies of an antenna device 10 and the antenna device according to the first embodiment.

FIG. 3 is a diagram for explaining the resonant frequencies of the antenna device 10 and the antenna device of the first embodiment. In FIG. 3, the vertical axis indicates reflection coefficient (return loss) and the horizontal axis indicates frequency. A graph 101 represents the reflection coefficient of the antenna device of the first embodiment for each frequency. A graph 102 represents the reflection coefficient of the antenna device 10 for each frequency. The resonant frequency of the antenna device of the first embodiment is the peak of the graph 101, which is 2.14 GHz. The resonant frequency of the antenna device 10 is the peak of the graph 102, which is 2.348 GHz. For example, in a mobile phone communication, for example, 2.11 to 2.17 GHz is used as in a downlink communication (WCDMA or LTE Band I). When the antenna device 10 is used in a mobile phone, the size of the mobile phone has to be increased in order to lower the resonant frequency. Therefore, when the antenna device of the first embodiment is used in a mobile phone, the size of the mobile phone is more compact than that of the mobile phone in which the antenna 10 is used.

Figure 4:
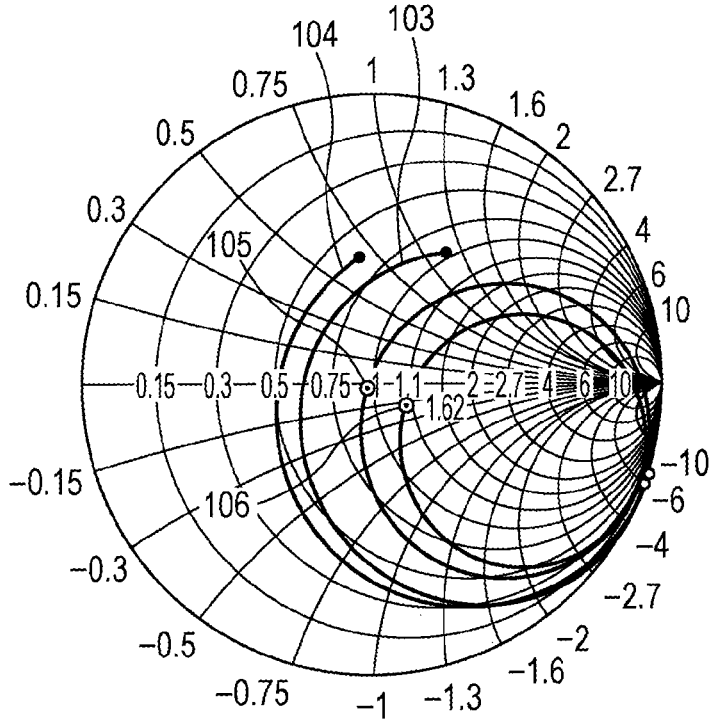
FIG. 4 is a Smith chart of the antenna device 10 and the antenna device according to the first embodiment.

FIG. 4 is a Smith chart illustrates the characteristics of the antenna device 10 and the antenna device according to the first embodiment. A graph 103 in FIG. 4 represents the input impedance for each frequency of the antenna device of the first embodiment. A graph 104 represents the input impedance for each frequency of the antenna device 10.

A point 105 on the graph 103 represents the input impedance at a frequency of 2.140 GHz. The real part and the imaginary part of the input impedance at the point 105 are 48.9Ω and −0.83Ω respectively. A point 106 on the graph 104 represents the input impedance at a frequency of 2.348 GHz. The real part and the imaginary part of the input impedance at the point 106 are 63.2Ω and −5.6Ω respectively. Here, the most matching condition is the center of the Smith chart, at which the real part is 50Ω and the imaginary part is 0Ω. It is found that the point 105 is nearer to the center than the point 106. In other words, the antenna device of the first embodiment is more matching than the antenna device 10. A Smith chart has constant resistance circles and the constant resistance circles share the right end portion. In the description below, the more outside in a Smith chart, the smaller the resistance (the real part of the impedance), and the more inside in the Smith chart, the larger the resistance. When the length of the inverted-L antenna is increased while the height is maintained at a constant height, a point in the Smith chart may be moved outside, and when the length of the slot is increased, the point in the Smith chart may be moved inside.

Here, the substantial length of the peninsula section 21 of the antenna device of the first embodiment may be longer than that of the antenna device 10. Both the inverted-L antenna 1 and the peninsula section 21 work together as an antenna, so that the antenna device of the first embodiment, in which the peninsula section 21 is long, located more outside than the antenna 10 in the Smith chart. The position of the antenna device 10 in the Smith chart is located more inside than the center, so that when the antenna device 10 is replaced by the antenna device of the first embodiment, the position in the Smith chart moves to outside and a matching condition is obtained. Here, to cause the antenna device 10 to have the same resonant frequency as that of the antenna device of the first embodiment, the size of the antenna device 10 has to be increased, so that the antenna device of the first embodiment is more compact than the antenna device 10.

As described above, when the peninsula section 21 has a meander shape, the resonant frequency may be lower than when only the slot 3 has a meander shape if both cases have the same placing area. Or, when the peninsula section 21 has a meander shape, the size may be more compact than when only the slot 3 has a meander shape if both cases have the same resonant frequency.

Figure 5A:
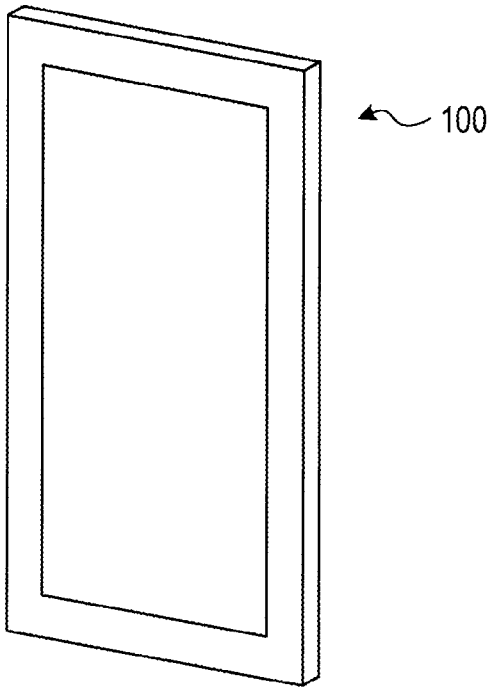
FIG. 5A is a schematic perspective view of a mobile phone including the antenna device according to the first embodiment.
Figure 5B:
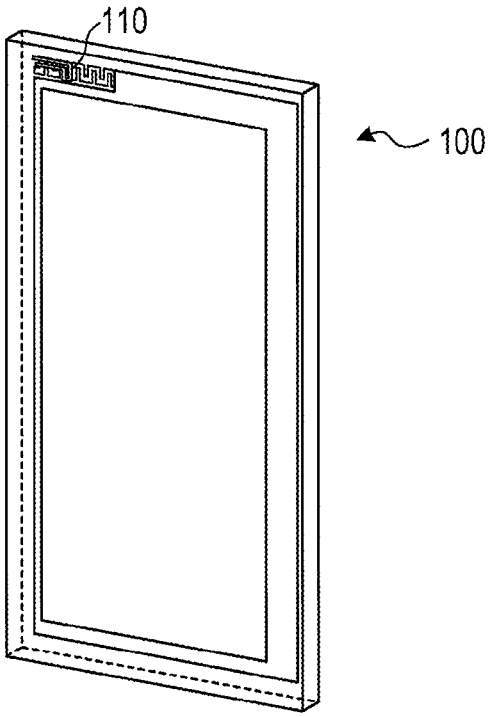
FIG. 5B is a transparent perspective view of the mobile phone including the antenna device according to the first embodiment.

FIG. 5A is a schematic perspective view of a mobile phone including the antenna device according to the first embodiment. FIG. 5B is a transparent perspective view of the mobile phone including the antenna device according to the first embodiment.

For example, the antenna device according to the first embodiment is included in a smartphone 100 as illustrated in FIG. 5A. The antenna device according to the first embodiment is included a housing of the smartphone 100 as illustrated by the antenna device 110 in FIG. 5B. The smartphone 100 has a wireless communication unit and a signal processing unit not illustrated in the drawings. The wireless communication unit receives a wireless signal through the antenna device 110. Also, the wireless communication unit transmits a signal received from the signal processing unit through the antenna device 110. The signal processing unit processes a signal received from the wireless communication unit and provides the processed signal to an operator. The signal processing unit processes data inputted from the operator and outputs the processed data to the wireless communication unit.

Although, here, an example is described in which the antenna device according to the first embodiment is included in a smartphone, the antenna device may be included a mobile phone other than a smartphone or may be included in a wireless communication device other than a mobile phone.

Modified Example

Figure 6A:
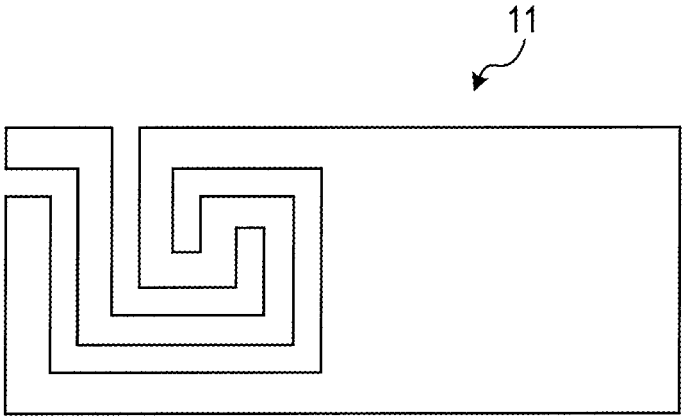
FIG. 6A is a diagram illustrating a modified example of the antenna device according to the first embodiment.
Figure 6B:
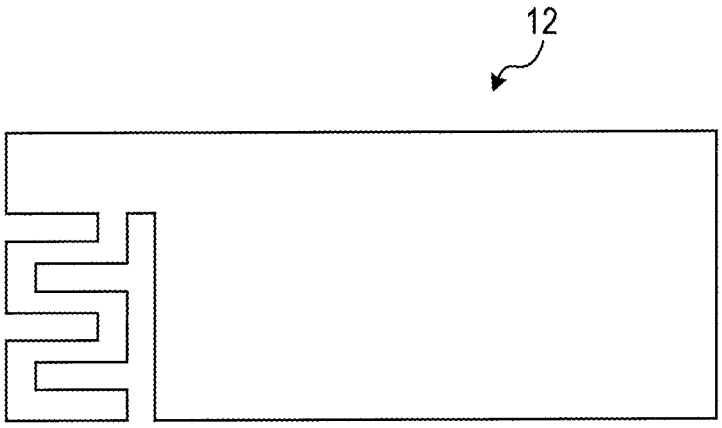
FIG. 6B is a diagram illustrating another modified example of the antenna device according to the first embodiment.

FIG. 6A is a diagram illustrating a modified example of the antenna device according to the first embodiment. FIG. 6B is a diagram illustrating another modified example of the antenna device according to the first embodiment.

To shorten the long side of the placing area, the slot may be crooked or bent. To increase the length of the peninsula section, the peninsula section may have a crooked or bent belt shape. Therefore, the slot and the peninsula section may have not only the meander shapes as illustrated in the first embodiment, but also other crooked or bent shapes.

For example, as illustrated by the substrate metal 11 in FIG. 6A, the slot and the peninsula section may have a helical shape. Also in this case, the long side of the placing area may be shorter than when the slot has a linear shape if both cases have the same resonant frequency. Or, in this case, the resonant frequency may be lower than when the slot has a linear shape if both cases have the same placing area and have a matching condition.

As another example, as illustrated by a substrate metal 12 in FIG. 6B, only the peninsula section may have a meander shape. When the peninsula section is long like the substrate metal 12, the substantial length of the antenna may be long, so that the resonant frequency in a matching condition may be lower than when the slot and the peninsula section have a linear shape.

As described above, the antenna device and the mobile phone according to the present embodiment and the modified example have a structure in which the substrate metal includes a crooked or bent slot whose opening is located at the end of the substrate metal and a crooked or bent peninsula section including the inverted-L antenna at the tip of the peninsula section. Thereby, the placing area of the substrate metal may be compact and space saving of the antenna device may be achieved. Further, it is possible to contribute to downsizing of a device, which uses an antenna device, such as a mobile phone. Further, even when the states of the slots are the same, the resonant frequency may be further lowered in a matching condition.

Second Embodiment

Figure 7A:
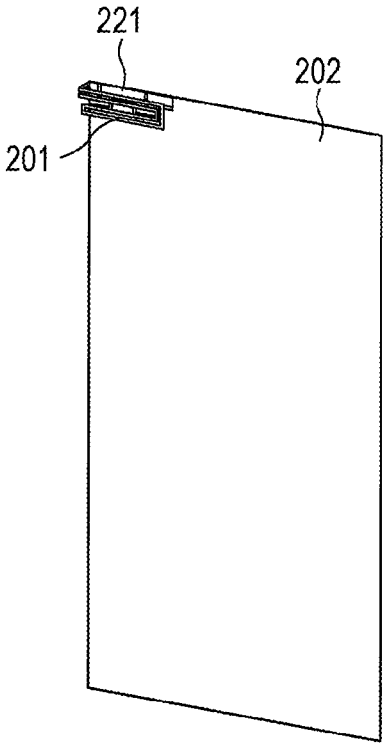
FIG. 7A is a perspective view of an entire substrate metal provided with an antenna device according to a second embodiment.
Figure 7B:
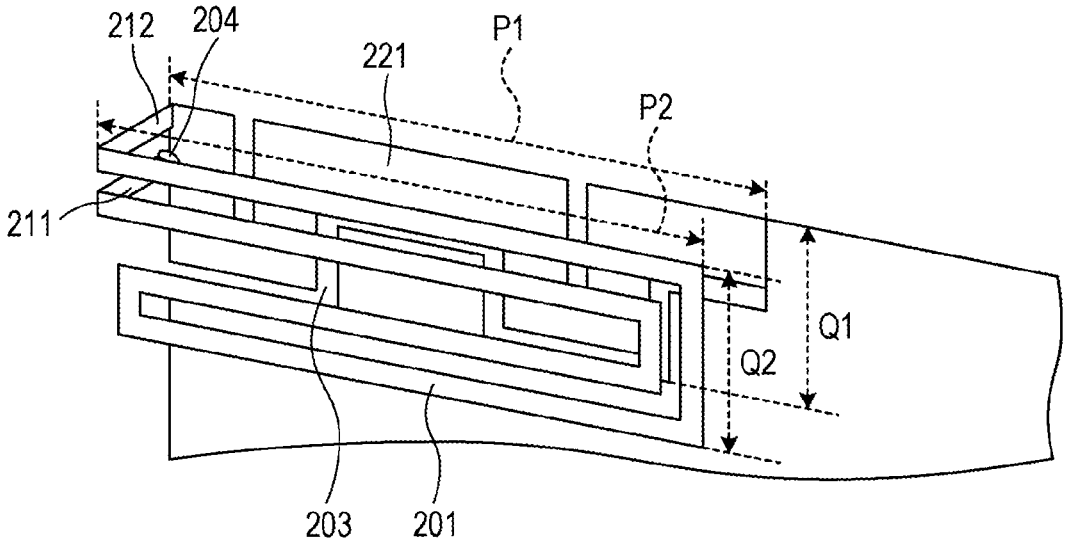
FIG. 7B is an enlarged view of the antenna device of FIG. 7A.

FIG. 7A is a perspective view of an entire substrate metal provided with an antenna device according to a second embodiment. FIG. 7B is an enlarged view of the antenna device of FIG. 7A.

As illustrated in FIGS. 7A and 7B, the antenna device according to the present embodiment is a folded inverted-L antenna modified from the antenna device according to the first embodiment. Thereby, the position in the Smith chart is more inside, so that it is possible to adjust to a matching condition by shorter slot length. In the inverted-L antenna, the slot occupies a large part of the placing area, so that it is possible to reduce the placing area by replacing the inverted-L antenna by the folded inverted-L antenna.

In the antenna device according to the present embodiment, a slot 203 having an opening near an end portion of a substrate metal 202 is provided in the substrate metal 202 in the same manner as in the first embodiment. Further, a crooked or bent-belt-shaped peninsula section 221 obtained by adding slits in a smaller area of two areas on both sides of the slot 203 in the substrate metal 202 is formed. Both of the slot 203 and the peninsula section 221 have a meander shape.

An antenna 201 is a folded inverted-L antenna which extends from one end 211, loops back, and returns to the other end 212. One end of the antenna 201 is placed near the tip of the peninsula section 221 through a feeding point 204. The other end of the antenna 201 is directly placed near the tip of the peninsula section 221.

The placing area formed by the slot 203 and the peninsula section 221 according to the present embodiment has a long side P1 of 14.3 mm and a short side Q1 of 4 mm. The height of the antenna 201 from the substrate metal 202 is 3 mm. A length P2 and a width Q2 of the antenna 201 are 14.5 mm and 4 mm respectively.

Figure 8:
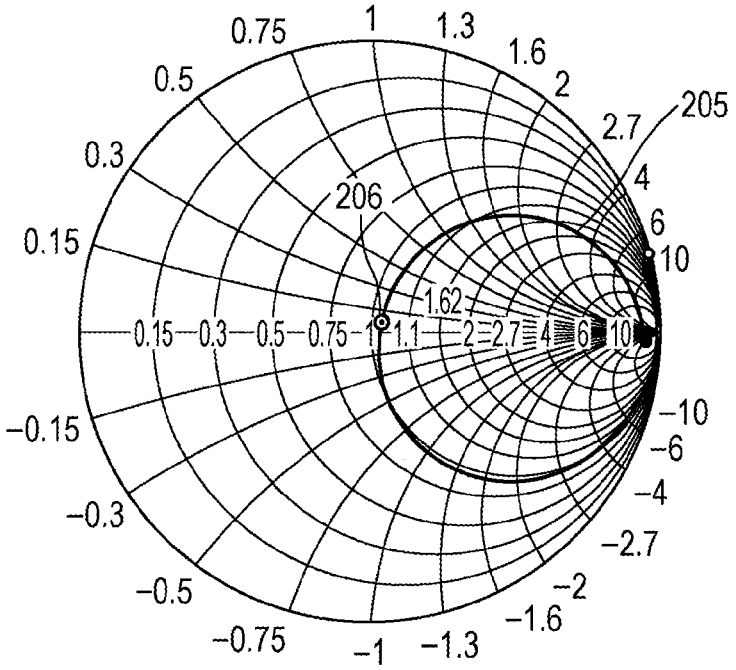
FIG. 8 is a Smith chart of the antenna device according to the second embodiment.

FIG. 8 is a Smith chart of the antenna device according to the second embodiment. A graph 205 represents the input impedance of the antenna device according to the present embodiment. A point 206 on the graph 205 represents the input impedance at a frequency of 2.14 GHz and the real part and the imaginary part of the input impedance are 53.888735Ω and 1.046130Ω respectively. In other words, the antenna device according to the present embodiment is located approximately at the center of the Smith chart at 2.14 GHz. In other words, the antenna device according to the present embodiment is in a good matching condition.

Figure 9:
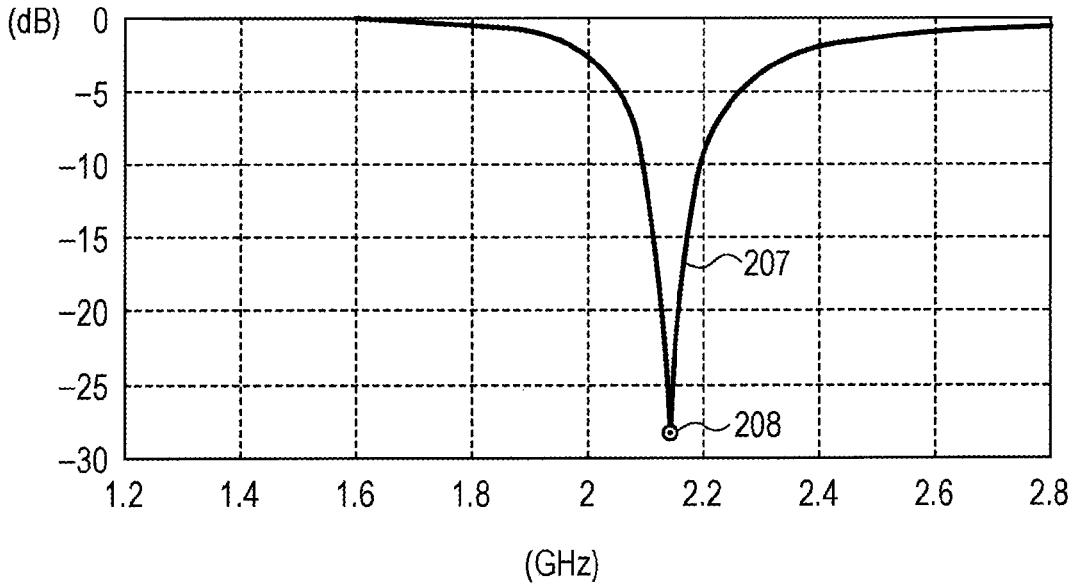
FIG. 9 is a diagram illustrating a resonant frequency of the antenna device according to the second embodiment.

FIG. 9 is a diagram illustrating the resonant frequency of the antenna device according to the second embodiment. In FIG. 9, the vertical axis indicates reflection coefficient and the horizontal axis indicates frequency. A graph 207 indicates the reflection coefficient of the antenna device according to the second embodiment for each frequency. The peak 208 on the graph 207 is the resonant frequency of the antenna device according to the second embodiment. The resonant frequency of the antenna device according to the second embodiment is 2.14 GHz. In other words, the resonant frequency of the antenna device according to the second embodiment is included in a range of 2.11 to 2.17 GHz, which is an example of the resonant frequency range of a mobile phone. Therefore, when the antenna device according to the second embodiment is used in a mobile phone, a high sensitivity is realized.

Here, a comparison between an antenna device in which the inverted-L antenna is used and an antenna device in which the folded inverted-L antenna is used will be described with reference to FIGS. 10 to 14B.

Figure 10:
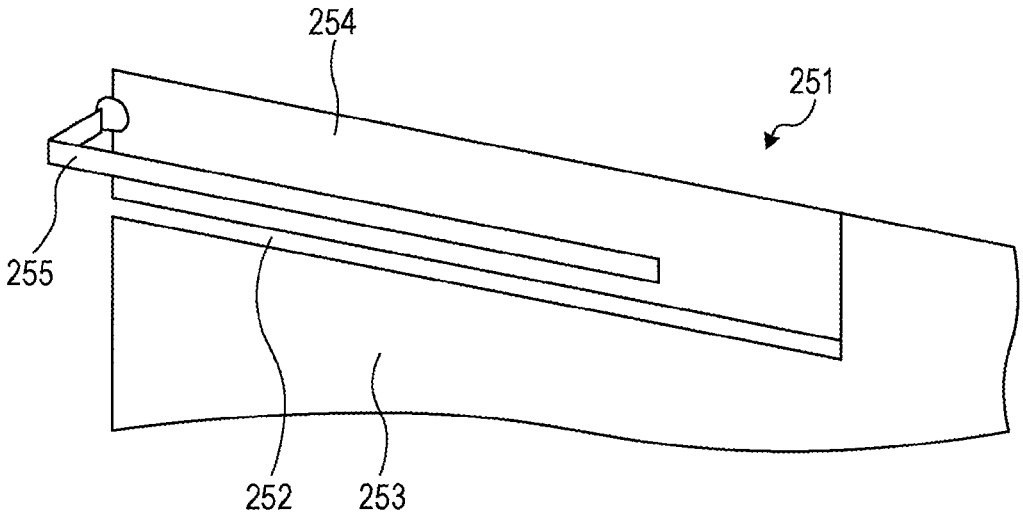
FIG. 10 is a diagram of an example of an antenna device in which an inverted-L antenna is used.
Figure 11:
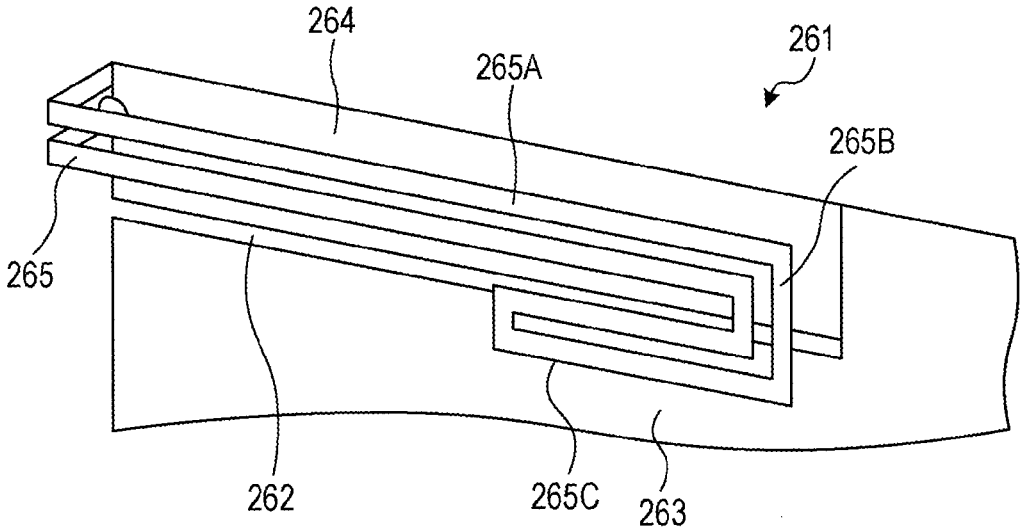
FIG. 11 is a diagram of an example of an antenna device in which a folded inverted-L antenna is used.
Figure 12A:
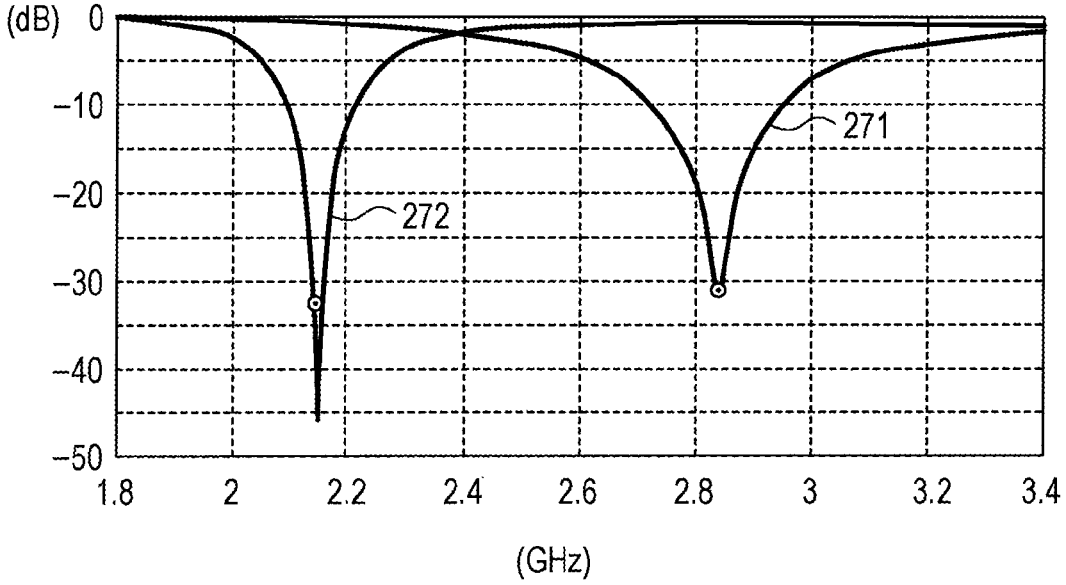
FIG. 12A is a diagram illustrating resonant frequencies of the antenna devices illustrated in FIGS. 10 and 11.
Figure 12B:
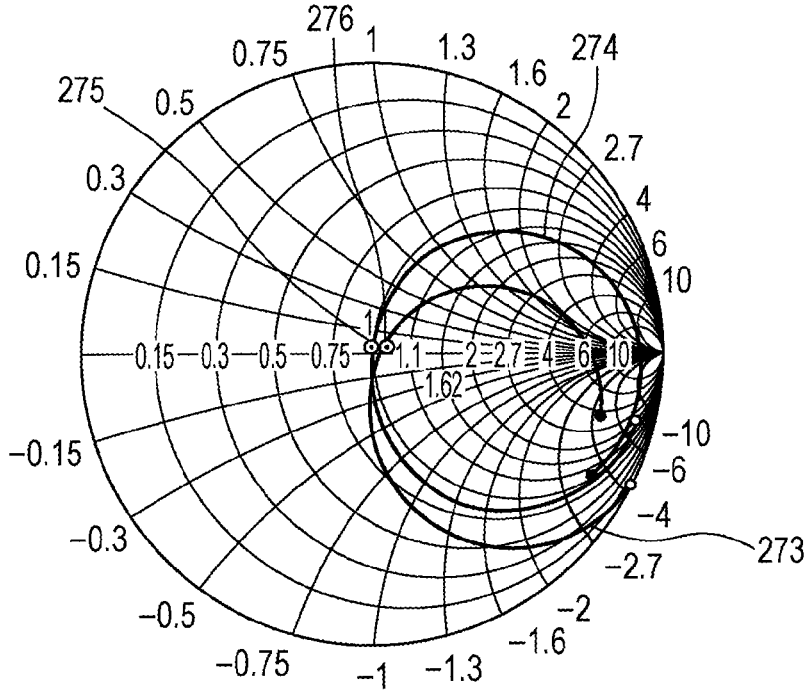
FIG. 12B is a Smith chart of the antenna devices illustrated in FIGS. 10 and 11.
Figure 13:
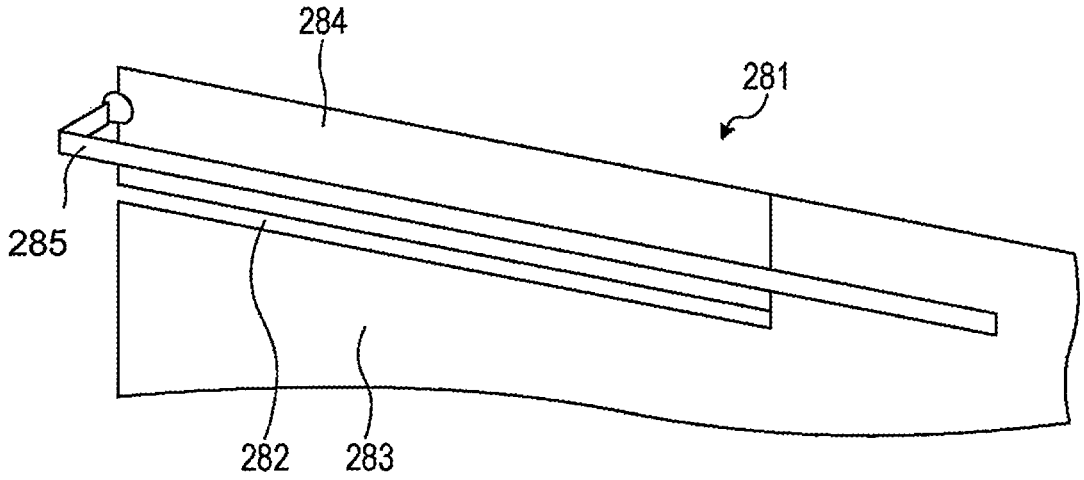
FIG. 13 is a diagram of another example of an antenna device in which an inverted-L antenna is used.
Figure 14A:
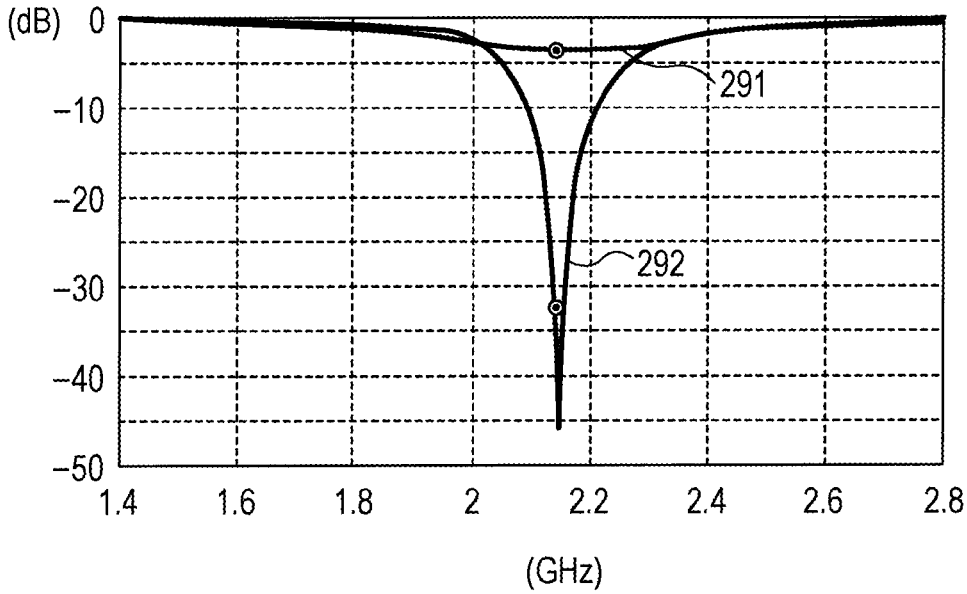
FIG. 14A is a diagram illustrating resonant frequencies of the antenna devices illustrated in FIGS. 13 and 11.
Figure 14B:
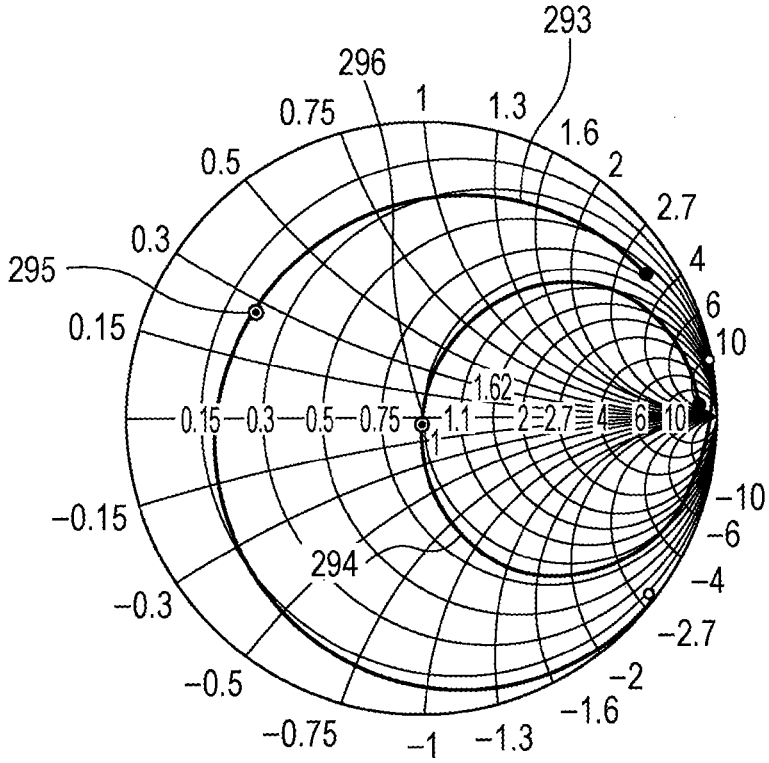
FIG. 14B is a Smith chart of the antenna devices illustrated in FIGS. 13 and 11.

FIG. 10 is a diagram of an example of the antenna device in which the inverted-L antenna is used. FIG. 11 is a diagram of an example of the antenna device in which the folded inverted-L antenna is used. FIG. 12A is a diagram illustrating resonant frequencies of the antenna devices illustrated in FIGS. 10 and 11. FIG. 12B is a Smith chart of the antenna devices illustrated in FIGS. 10 and 11. FIG. 13 is a diagram of another example of an antenna device in which an inverted-L antenna is used. FIG. 14A is a diagram illustrating resonant frequencies of the antenna devices illustrated in FIGS. 13 and 11. FIG. 14B is a Smith chart of the antenna devices illustrated in FIGS. 13 and 11.

A slot 252 in an antenna device 251 illustrated in FIG. 10 has a width of 0.5 mm and a length of 20 mm. A substrate metal 253 has a width of 50 mm (the length direction of the slot 252) and a length of 100 mm (the width direction of the slot 252). A peninsula section 254 has a width of 3.5 mm and a length of 20 mm. An inverted-L antenna 255 has a length of 16.2 mm. A slot 262, a substrate metal 263, and a peninsula section 264 of an antenna device 261 illustrated in FIG. 11 have the same sizes as those of the slot 252, the substrate metal 253, and the peninsula section 254, respectively, in FIG. 10. In a folded inverted-L antenna 265, the length of a line segment 265A is 20 mm, the length of a line segment 265B is 4 mm, and the length of a line segment 265C is 8 mm. In short, the antenna device 251 is the same as the antenna device 261 except for the shapes of the antennas.

In FIG. 12B, a graph 273 represents the input impedance for each frequency of the antenna device 251 and a graph 274 represents the input impedance for each frequency of the antenna device 261. A point 276 on the graph 273 represents the input impedance at a frequency of 2.83 GHz and the real part and the imaginary part of the input impedance are 51.89Ω and −2.06Ω respectively. A point 275 on the graph 274 represents the input impedance at a frequency of 2.14 GHz and the real part and the imaginary part of the input impedance are 49.30Ω and −2.22Ω respectively. In this case, as illustrated in FIG. 12B, the impedances of the antenna device 251 and the antenna device 261 are located approximately at the center of the Smith chart. In short, in this case, both the antenna device 251 and the antenna device 261 are in a good matching condition.

A graph 271 in FIG. 12A represents the reflection coefficient of the antenna device 251 for each frequency. A graph 272 represents the reflection coefficient of the antenna device 261 for each frequency. As illustrated in FIG. 12A, the peak of the graph 271, which is the resonant frequency of the antenna device 251, is 2.83 GHz. On the other hand, the peak of the graph 272, which is the resonant frequency of the antenna device 261, is 2.14 GHz.

On the other hand, in an antenna device 281 illustrated in FIG. 13, the sizes of a slot 282, a substrate metal 283, and a peninsula section 284 are the same as those of the antenna device 251 in FIG. 10, and the length of an inverted-L antenna 285 is 28.9 mm.

A graph 291 in FIG. 14A represents the reflection coefficient of the antenna device 281 for each frequency. A graph 292 represents the reflection coefficient of the antenna device 261 for each frequency. As illustrated in FIG. 14A, the peak of the graph 291, which is the resonant frequency of the antenna device 281 and the peak of the graph 292, which is the resonant frequency of the antenna device 261 represent the same resonant frequency of 2.14 GHz.

In FIG. 14B, a graph 293 represents the input impedance for each frequency of the antenna device 281 and a graph 294 represents the input impedance for each frequency of the antenna device 261. In this case, as illustrated by a point 295 on the graph 293, the real part and the imaginary part of the input impedance of the antenna device 281 at 2.14 GHz are 10.66Ω and 14.00Ω respectively. On the other hand, as illustrated by a point 296 on the graph 294, the real part and the imaginary part of the input impedance of the antenna device 261 at 2.14 GHz are 49.30Ω and −2.22Ω respectively. In other words, the antenna device 261 has a matching condition better than that of the antenna device 281.

Therefore, if the slot lengths are the same, the antenna device 261 in which the folded inverted-L antenna 265 is used may lower the resonant frequency while a good matching condition is maintained in comparison with the antenna device 281 in which the inverted-L antenna 285 is used.

When the long side and the short side of the placing area width are 4 mm respectively and the height of the antenna is 3 mm, if the resonant frequency is set to 2.14 GHz, the slot length of the inverted-L antenna will be 26.4 mm. On the other hand, if the folded inverted-L antenna satisfies the same condition as described above, the slot length will be 20.0 mm.

In this way, when the folded inverted-L antenna is used, the slot may be shorter than when the inverted-L antenna is used.

As described above, the placing area of the antenna device in which the folded inverted-L antenna is used as in the second embodiment may be more compact than that in the first embodiment, so that space saving may be realized. Further, it is possible to contribute to downsizing and thinning of a housing of a device which uses an antenna device.

Modified Example

Figure 15:
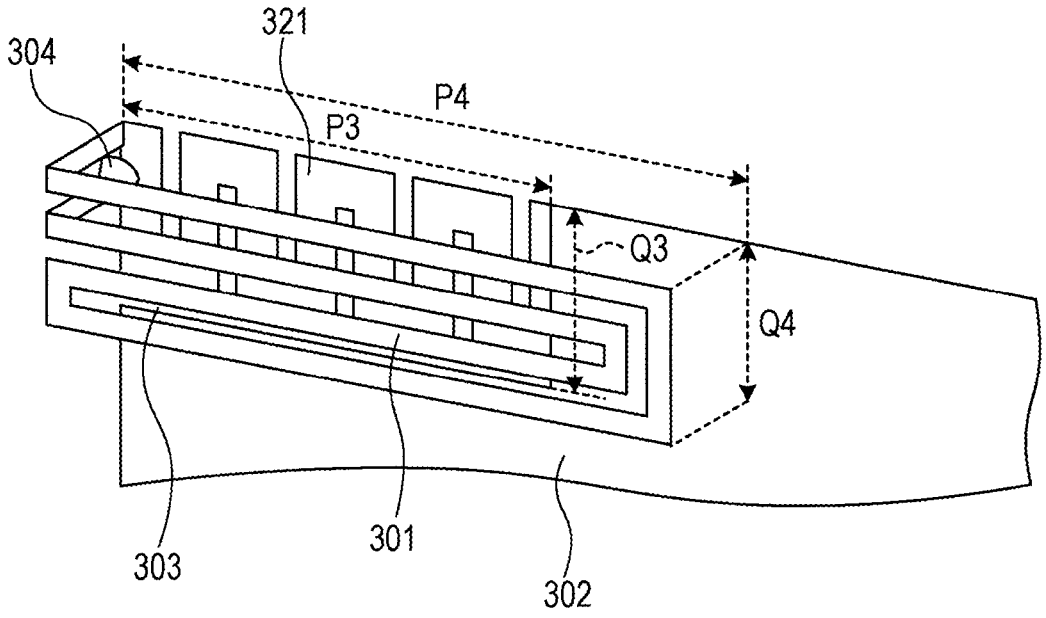
FIG. 15 is a perspective view of an antenna device according to a modified example of the second embodiment.

The sizes and shapes of the peninsula section and the folded inverted-L antenna may be different from those described in the above second embodiment. FIG. 15 is a perspective view of an antenna device according to a modified example of the second embodiment.

The placing area including a peninsula section 321 and a slot 303 of the antenna device illustrated in FIG. 15 has a long side P3 of 11 mm and a short side Q3 of 4 mm. A length P4 and a width Q4 of an antenna 301 are 15.9 mm and 3.5 mm respectively and the height of the antenna 301 from the substrate metal 302 is 3 mm. Further, in the antenna device illustrated in FIG. 15, the peninsula section 321 has a meander shape and a slot 303 has a shape in which several slits are formed transversely from the linear slot. Further, the antenna device illustrated in FIG. 15 has a feeding point 304.

Figure 16A:
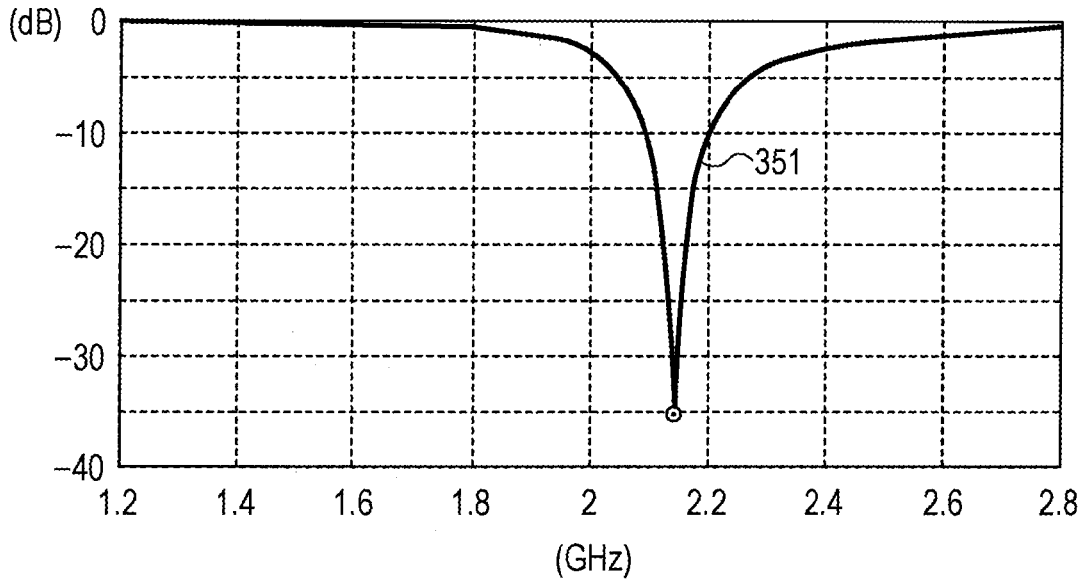
FIG. 16A is a diagram illustrating a resonant frequency of the antenna device of FIG. 15.
Figure 16B:
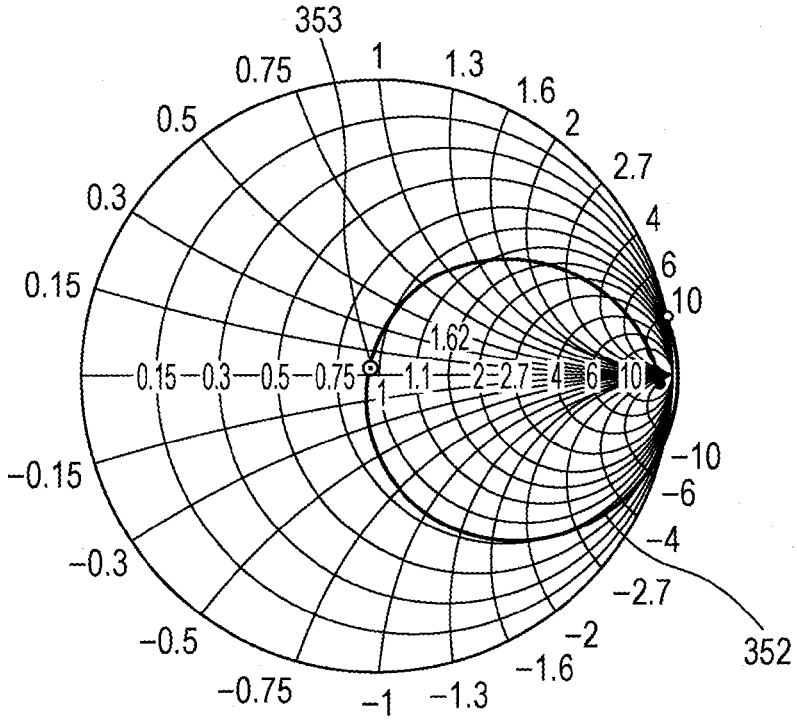
FIG. 16B is a Smith chart of the antenna device of FIG. 15.

FIG. 16A is a diagram illustrating the resonant frequency of the antenna device of FIG. 15. FIG. 16B is a Smith chart of the antenna device of FIG. 15.

A graph 351 in FIG. 16A represents the reflection coefficient for each frequency of the antenna device in FIG. 15. The peak of the graph 351, which is the resonant frequency of the antenna device in FIG. 15, is 2.14 GHz. This is within a range of 2.11 to 2.17 GHz, which is an example range of a downlink frequency band of a mobile phone. Therefore, when the antenna device in FIG. 15 is used in a mobile phone, a high sensitivity is realized.

A graph 352 in the Smith chart in FIG. 16B represents the input impedance for each frequency of the antenna device in FIG. 15. A point 353 on the graph 352 is the input impedance of the antenna device in FIG. 15 at 2.14 GHz, and the real part and the imaginary part of the input impedance are 48.323383Ω and 0.413102Ω respectively. This is located approximately at the center of the Smith chart. Therefore, the antenna device in FIG. 15 is in a good matching condition.

As described above, when the folded inverted-L antenna is used, even if both the peninsula section and the slot do not have a meander shape, an antenna device which is high sensitive and is in a good matching condition may be formed. Also in this case, the folded inverted-L antenna is used, so that the placing area may be more compact than when the inverted-L antenna is used and it is easy to downsize and thin the housing. When the slot lengths are the same, it is possible to further lower the resonant frequency and improve the sensitivity while the matching condition is maintained. When the inverted-L antenna is used, if the position is outside in the Smith chart, the position may be moved closer to the matching condition.

Third Embodiment

Figure 17A:
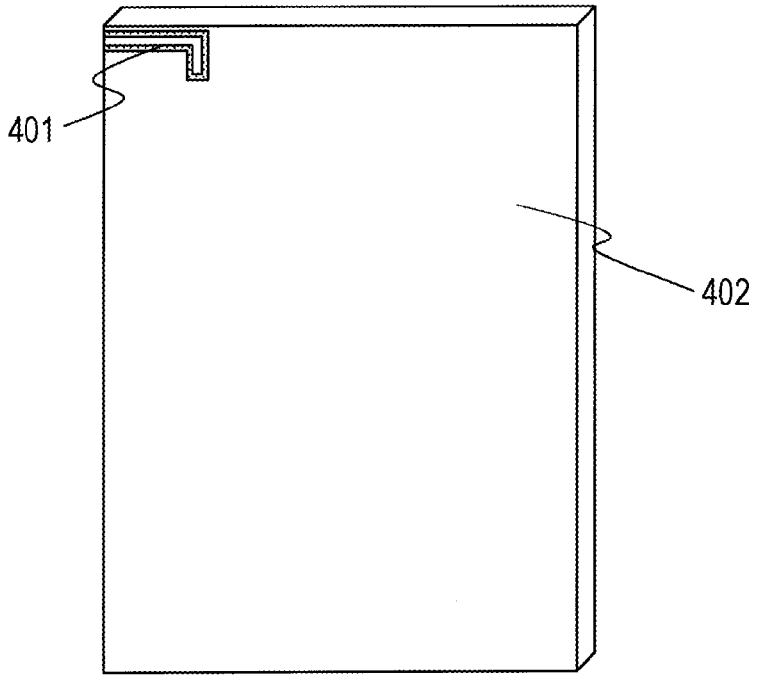
FIG. 17A is a perspective view of an antenna device according to a third embodiment.
Figure 17B:
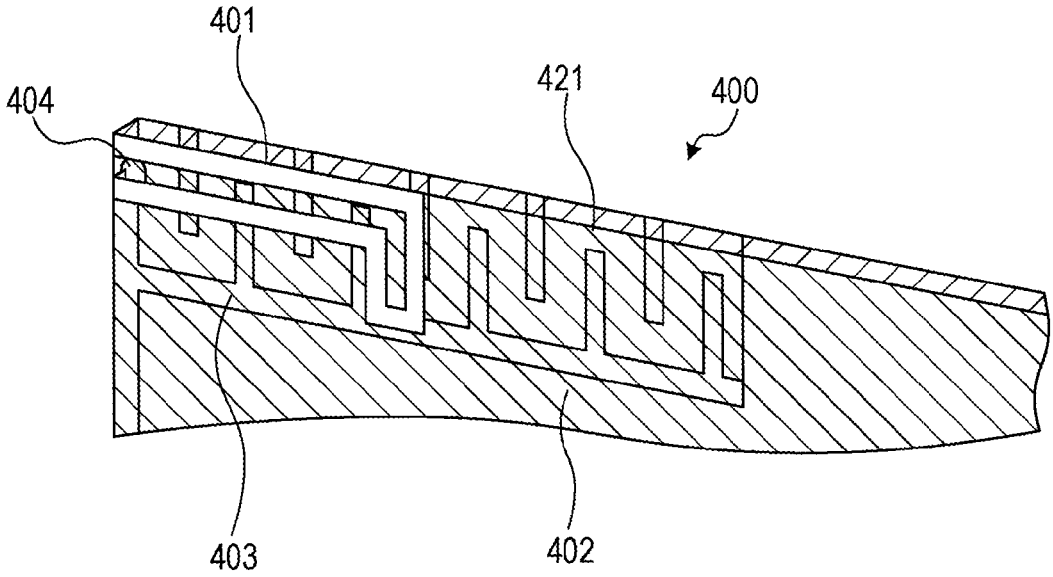
FIG. 17B is a transparent perspective view of the antenna device according to the third embodiment.

FIG. 17A is a perspective view of an antenna device according to a third embodiment. FIG. 17B is a transparent perspective view of the antenna device according to the third embodiment.

As illustrated in FIGS. 17A and 17B, the antenna device according to the present embodiment has a structure in which a pattern of an antenna is provided on both sides of a substrate 402. Here, the antenna device illustrated in FIG. 17B is referred to as an antenna device 400. The antenna device 400 of the present embodiment uses a folded inverted-L antenna.

Here, in the present embodiment, the substrate 402 has a structure in which a plastic dielectric material having a plate shape is sandwiched by metal plates. The metal plates provided on both sides of the substrate 402 correspond to the substrate metal described in the above embodiments. The thickness of the substrate 402 is 1 mm. The relative dielectric constant of a plastic portion of the substrate 402 is 4.2. The position of the substrate metal is not limited to the surface of the plastic, but may be inside the plastic. The substrate 402 may be a multilayer substrate.

A pattern of a slot 403 and a peninsula section 421 is formed by cutting a metal surface on one side of the substrate 402. A feeding point 404 is provided at the tip of the peninsula section 421. Further, one end of a folded inverted-L antenna 401 is connected to the feeding point 404. The metal is cut so that the folded inverted-L antenna 401 extends along a side surface of the substrate 402, bends when reaching the other metal surface, further extends and bends on the other metal surface, returns so that the other end comes into contact with the peninsula section, so that the folded inverted-L antenna 401 is formed as an folded-L antenna. The side surface portion of the folded inverted-L antenna might not be a side surface, but may be a via or the like.

In the present embodiment, the placing area formed by the peninsula section 421 and the slot 403 has a long side of 15.5 mm and a short side of 4 mm. The antenna 401 has a length of 8 mm and a width of 3.35 mm.

Figure 18:
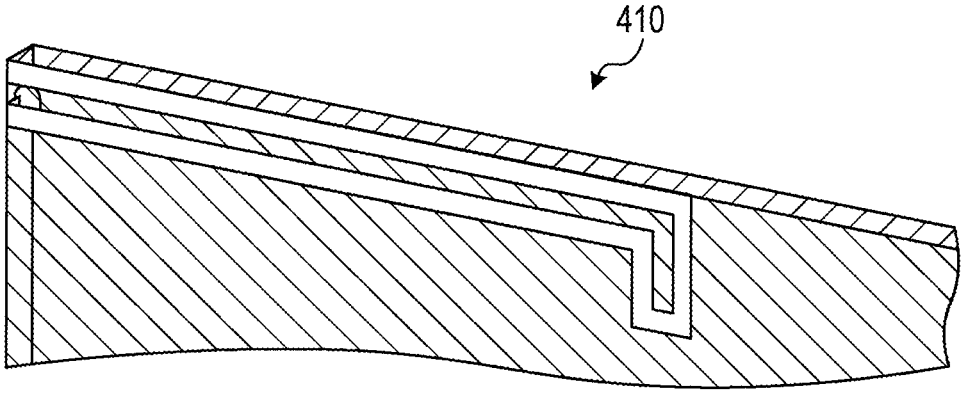
FIG. 18 is a diagram of an antenna device in which no slot is provided.

FIG. 18 is a diagram of an antenna device in which no slot is provided. As illustrated in FIG. 18, an antenna device 410 has a shape in which a pattern of a folded inverted-L antenna is provided on one surface of a substrate metal and no slot is provided on the other surface. In the present embodiment, to match the resonant frequency, the antenna has a length of 17.5 mm and a width of 3.5 mm.

Figure 19A:
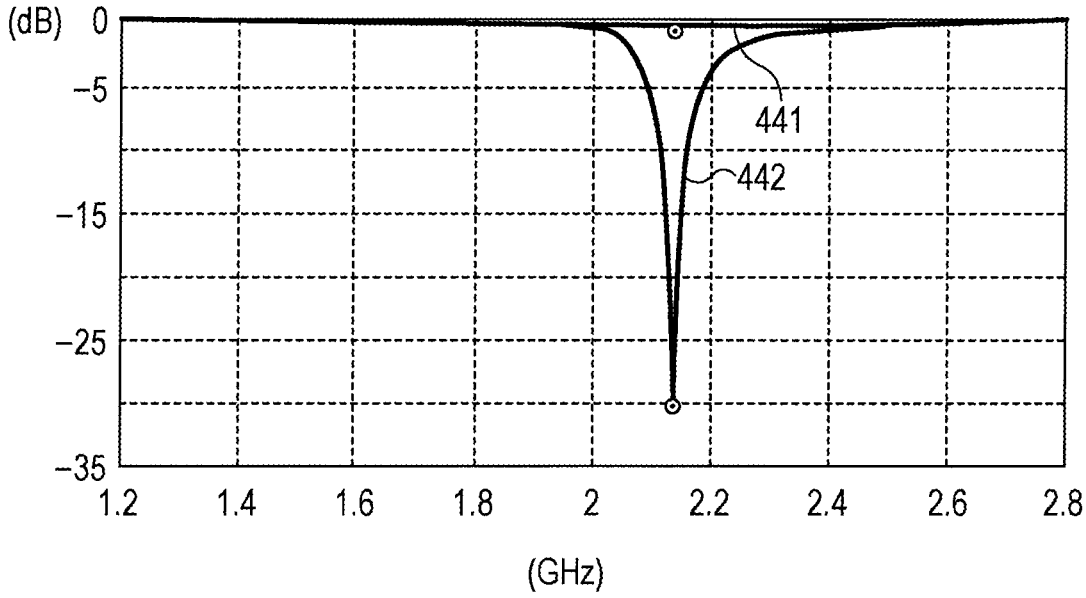
FIG. 19A is a diagram illustrating resonant frequencies of an antenna device 400 and an antenna device 410.
Figure 19B:
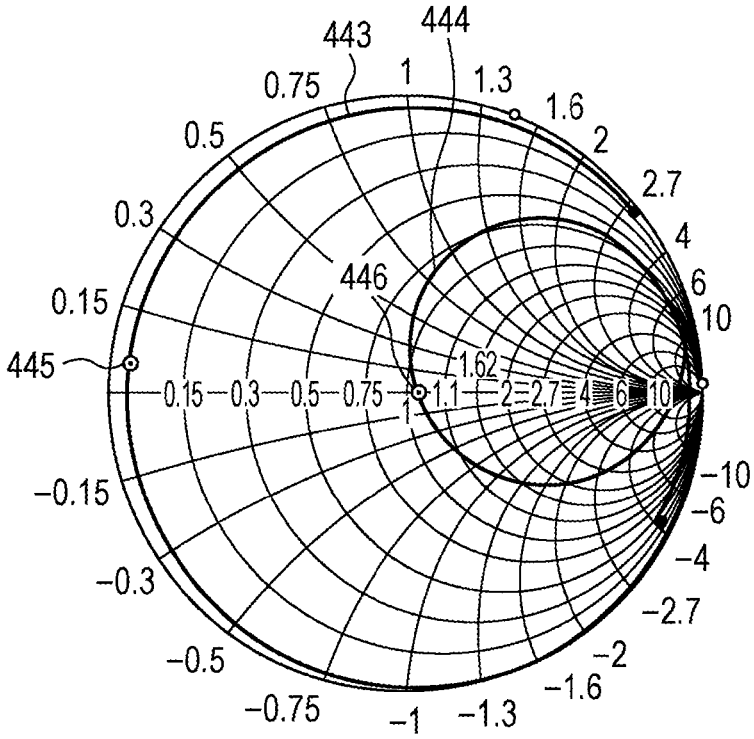
FIG. 19B is a Smith chart of the antenna device 400 and the antenna device 410.

FIG. 19A is a diagram illustrating the resonant frequencies of the antenna device 400 and the antenna device 410. FIG. 19B is a Smith chart of the antenna device 400 and the antenna device 410.

A graph 441 in FIG. 19A represents the reflection coefficient for each frequency of the antenna device 410. A graph 442 represents the reflection coefficient for each frequency of the antenna device 400. The peak of the graph 441, which is the resonant frequency of the antenna device 410, is 2.14 GHz. The peak of the graph 442, which is the resonant frequency of the antenna device 400, is 2.14 GHz. In short, the antenna device 400 and the antenna device 410 have the same resonant frequency.

A graph 443 in the Smith chart in FIG. 19B represents the input impedance for each frequency of the antenna device 410. A graph 444 represents the impedance for each frequency of the antenna device 400. A point 445 on the graph 443 is the input impedance of the antenna device 410 at 2.14 GHz, and the real part and the imaginary part of the input impedance are 1.545Ω and 2.70Ω respectively. On the other hand, a point 446 on the graph 444 is the input impedance of the antenna device 400 at 2.14 GHz, and the real part and the imaginary part of the input impedance are 52.55Ω and 1.88Ω respectively. In other words, the impedance of the antenna device 400 is located approximately at the center of the Smith chart. However, the impedance of the antenna device 410 is far away from the center of the Smith chart. Therefore, the antenna device 400 has a matching condition better than that of the antenna device 410.

As described above, also in the antenna device in which a pattern of an antenna, a slot, and a peninsula section is formed on both sides of the substrate metal, an antenna device including a crooked- or bent-belt-shaped slot and a crooked- or bent-belt-shaped peninsula section may have a lower resonant frequency and a better matching condition in comparison with an antenna device including no slot and no peninsula section.

In short, an antenna device in which a pattern of an antenna, a slot, and a peninsula section is formed on both sides of the substrate metal as in the third embodiment may have a low resonant frequency and a good matching condition. Further, the placing area may be more compact than that in the first embodiment, so that it is easy to downsize and thin the housing. A pattern is formed on both sides of the substrate metal, so that it is possible to reduce the number of components when the antenna device is used in a mobile phone. Even when the substrate is a multilayer substrate or the metal is covered by a dielectric material, the substrate may be used. Further, it is possible to contribute to thinning and downsizing of a mobile phone.

Here, in the third embodiment described above, a case is described in which the peninsula section has a meander shape and the slot has a shape in which several slits are formed transversely from the linear slot. However, the shapes of the peninsula section and the slot are not limited to those shapes. For example, both the peninsula section and the slot illustrated in the third embodiment may have a meander shape or the peninsula section and the slot may have a helical shape.

In the third embodiment described above, a case is described in which a folded inverted-L antenna is used as an antenna. However, the antenna may be an inverted-L antenna. Therefore, a modified example of the third embodiment will be described below.

Modified Example

Figure 20A:
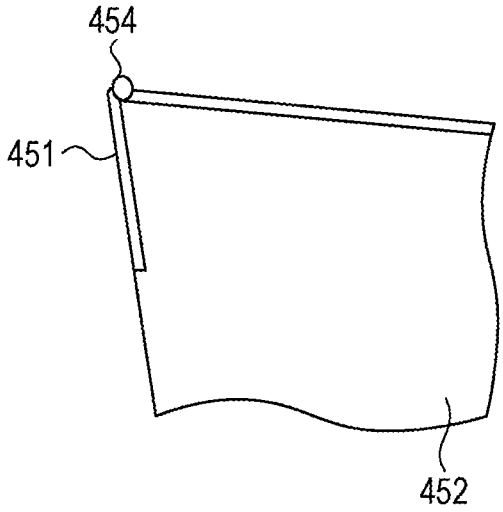
FIG. 20A is a perspective view of an antenna device according to a modified example of the third embodiment.
Figure 20B:
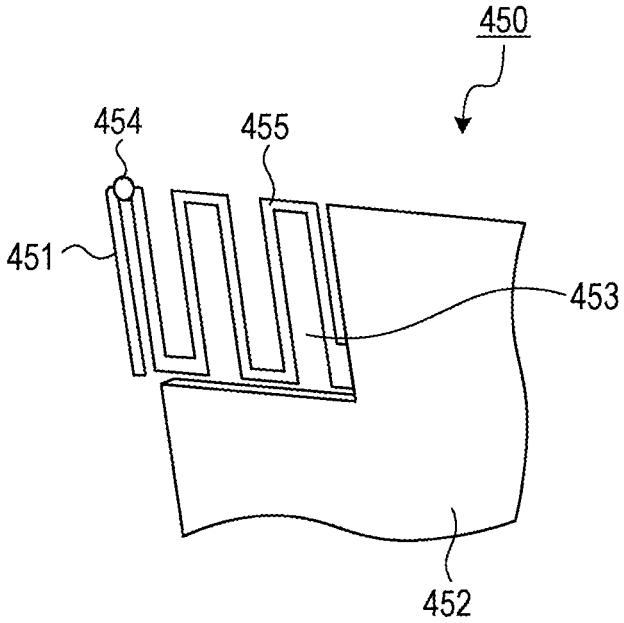
FIG. 20B is a transparent perspective view of the antenna device according to the modified example of the third embodiment.

FIG. 20A is a perspective view of an antenna device according to a modified example of the third embodiment. FIG. 20B is a transparent perspective view of the antenna device according to the third embodiment.

As illustrated in FIGS. 20A and 20B, the antenna device according to the present embodiment also has a structure in which a pattern of an antenna is provided on both sides of a substrate 452. Here, the antenna device illustrated in FIG. 20B is referred to as an antenna device 450.

Here, in the present modified example, the substrate 452 has a size of 50 mm by 50 mm by 1 mm. The substrate 452 has a structure in which a plastic dielectric material having a plate shape is sandwiched by metal plates. The relative dielectric constant of a plastic portion of the substrate 452 is 4.2.

A pattern of a slot 453 and a peninsula section 455 is formed by cutting a metal surface on one side of the substrate 452. A feeding point 454 is provided at the tip of the peninsula section 455. Further, one end of an inverted-L antenna 451 is connected to the feeding point 454. A metal surface on the other side is cut so that the inverted-L antenna 451 extends along a side surface of the substrate 452, bends when reaching the metal surface on the other side, and extends on the metal surface on the other side, so that the inverted-L antenna 451 is formed as an inverted-L antenna.

Figure 21A:
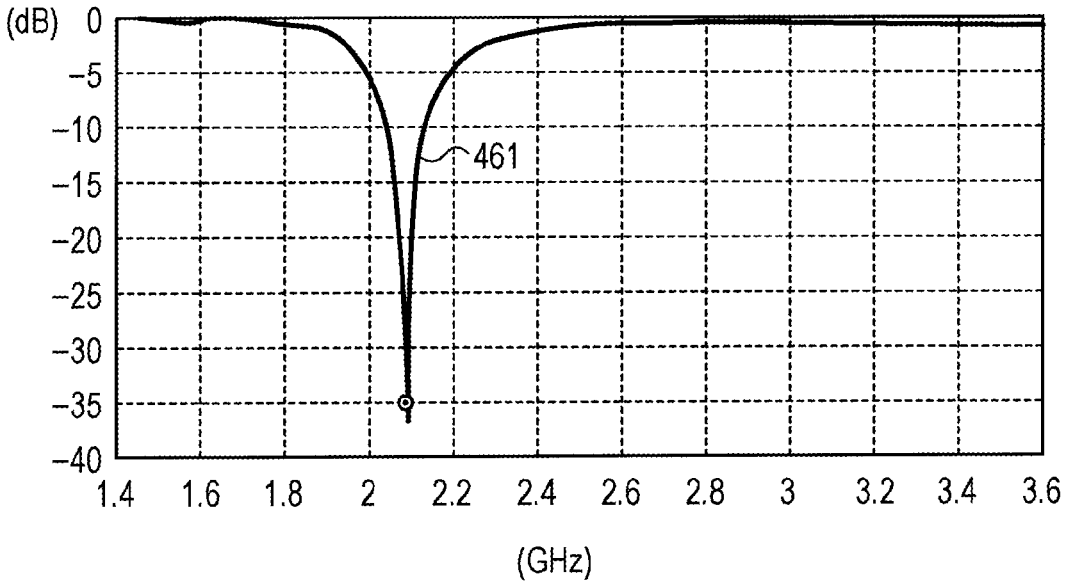
FIG. 21A is a diagram illustrating a resonant frequency of an antenna device 450.
Figure 21B:
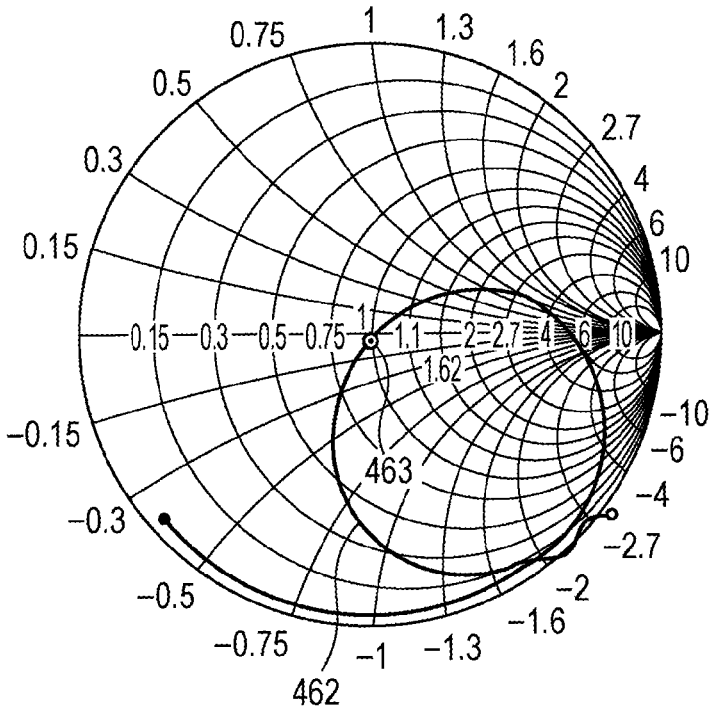
FIG. 21B is a Smith chart of the antenna device 450.

FIG. 21A is a diagram illustrating the resonant frequency of the antenna device 450. FIG. 21B is a Smith chart of the antenna device 450.

A graph 461 in FIG. 21A represents the reflection coefficient for each frequency of the antenna device 450. The peak of the graph 461, which is the resonant frequency of the antenna device 450, is 2.088 GHz. This is a sufficient value for the resonant frequency used in a mobile phone. Therefore, when the antenna device in FIG. 20 is used in a mobile phone, the antenna device will be high sensitive.

A graph 462 in the Smith chart in FIG. 21B represents the input impedance for each frequency of the antenna device 450. A point 463 on the graph 462 is the impedance at 2.088 GHz, and the real part and the imaginary part of the impedance are 50.277166Ω and −1.725353Ω respectively. This is located approximately at the center of the Smith chart. Therefore, the antenna device 450 is in a good matching condition.

Therefore, an antenna device in which a pattern of an antenna, a slot, and a peninsula section is formed on both sides of the substrate metal as in the present modified example may have a low resonant frequency and a good matching condition. The placing area may be more compact than that in the first embodiment, so that it is easy to downsize and thin the housing. A pattern is formed on both sides of the substrate metal, so that it is possible to reduce the number of components when the antenna device is used in a mobile phone. Even when the substrate is a multilayer substrate or the metal is covered by a dielectric material, the substrate may be used. Further, it is possible to contribute to thinning and downsizing of a mobile phone.

Fourth Embodiment

Figure 22:
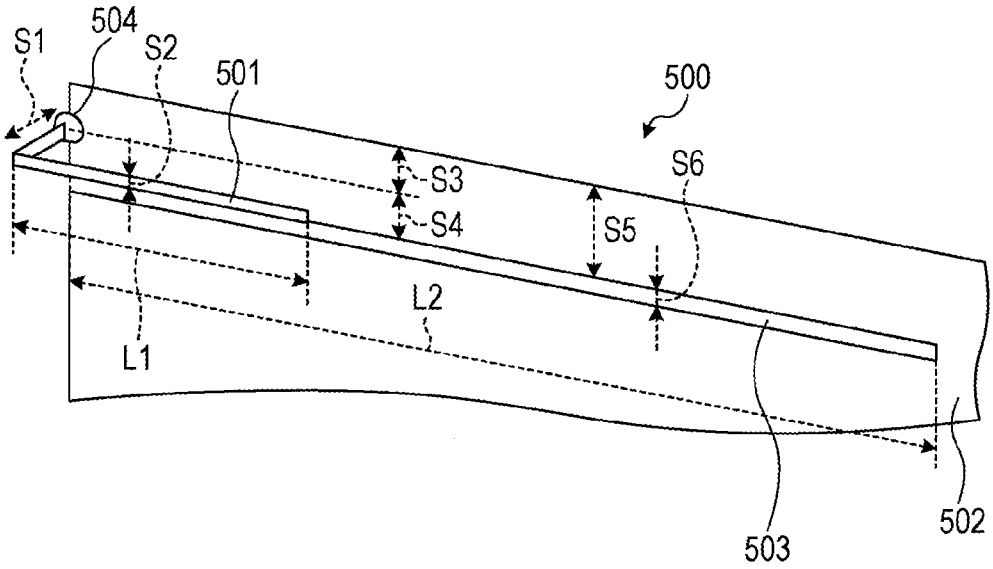
FIG. 22 is a perspective view of an antenna device according to a fourth embodiment.

Next, an antenna device according to a fourth embodiment will be described with reference to FIG. 22. FIG. 22 is a perspective view of the antenna device according to the fourth embodiment.

In an antenna device 500, a linear slot 503 is provided in the substrate metal 502. In the present embodiment, the substrate metal 502 has a length of 100 mm and a width of 50 mm. A distance S5 from the edge of the substrate metal 502 to the slot 503 is 3 mm. The slot 503 has a width S6 of 0.5 mm. The length of the slot 503 is defined as L2.

A feeding point 504 is provided within a distance of λ/10 (λ is a wavelength of the resonant frequency) from the tip of the peninsula section which is the smaller area of the two areas separated by the slot 503 of the substrate metal 502. For example, when the resonant frequency is 2.14 GHz, λ is 140 mm. In the present embodiment, the feeding point 504 is provided at a position, which is located at the tip of the peninsula section, and the distances S3 and S4 from which to the edge of the substrate metal 502 and the slot 503 are 1.5 mm and 1.5 mm, respectively.

An inverted-L antenna 501 is connected to the substrate metal 502 through the feeding point 504. In the present embodiment, the height S1 of the inverted-L antenna 501 from the substrate metal 502 is 3 mm. The width S2 of the inverted-L antenna 501 is 0.5 mm. Further, the length of the inverted-L antenna 501 is defined as L1.

Figure 23:
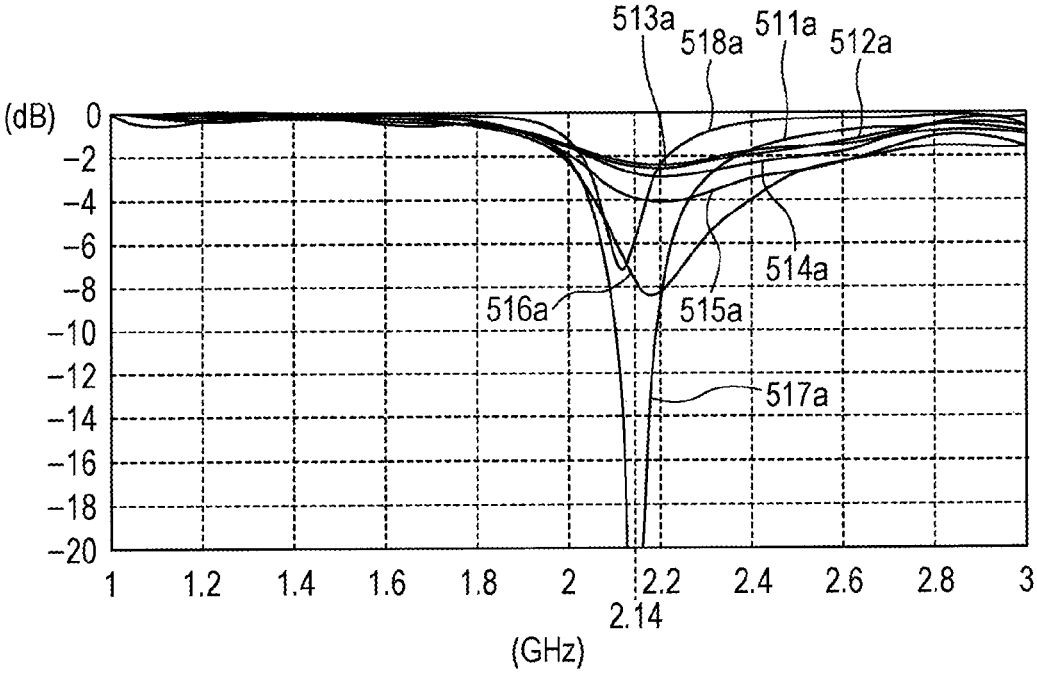
FIG. 23 is a diagram illustrating resonant frequencies when a length L2 of a slot and a length L1 of an antenna are changed.

Here, FIG. 23 is a diagram illustrating the resonant frequencies when the lengths of the slot and the antenna are changed. A graph 511*a* represents the reflection coefficient for each frequency in the case of (L2, L1)=(0, 30.80). A graph 512*a* represents the reflection coefficient for each frequency in the case of (L2, L1)=(5, 30.33). A graph 513*a* represents the reflection coefficient for each frequency in the case of (L2, L1)=(10, 29.52). A graph 514*a* represents the reflection coefficient for each frequency in the case of (L2, L1)=(15, 28.33). A graph 515*a* represents the reflection coefficient for each frequency in the case of (L2, L1)=(20, 26.42). A graph 516*a* represents the reflection coefficient for each frequency in the case of (L2, L1)=(25, 22.41). A graph 517*a* represents the reflection coefficient for each frequency in the case of (L2, L1)=(28, 16.80). A graph 518*a* represents the reflection coefficient for each frequency in the case of (L2, L1)=(30, 10.12).

As illustrated in FIG. 23, all the peaks of the graphs 511*a* to 518*a* are 2.14 GHz. In other words, the resonant frequencies in all the cases of (L2, L1)=(0, 30.80), (5, 30.33), (10, 29.52), (15, 28.33), (20, 26.42), (25, 22.41), (28, 16.80), and (30, 10.12) are the same.

Figure 24:
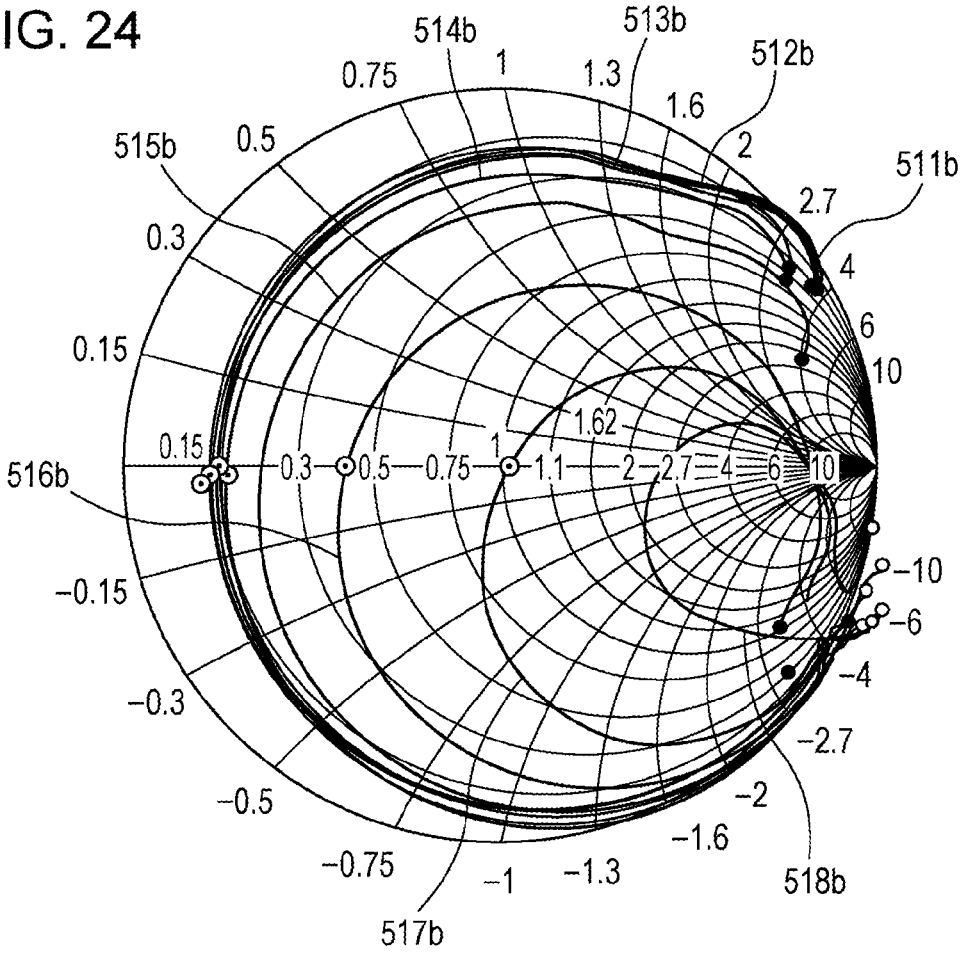
FIG. 24 is a Smith chart corresponding to FIG. 23.

FIG. 24 is a Smith chart corresponding to a case in which the lengths of the slot and the antenna in FIG. 23 are changed. A graph 511*b* represents the input impedance for each frequency in the case of (L2, L1)=(0, 30.80). A graph 512*b* represents the input impedance for each frequency in the case of (L2, L1)=(5, 30.33). A graph 513*b* represents the input impedance for each frequency in the case of (L2, L1)=(10, 29.52). A graph 514*b* represents the input impedance for each frequency in the case of (L2, L1)=(15, 28.33). A graph 515*b* represents the input impedance for each frequency in the case of (L2, L1)=(20, 26.42). A graph 516*b* represents the input impedance for each frequency in the case of (L2, L1)=(25, 22.41). A graph 517*b* represents the input impedance for each frequency in the case of (L2, L1)=(28, 16.80). A graph 518*b* represents the input impedance for each frequency in the case of (L2, L1)=(30, 10.12).

The real part and the imaginary part of the input impedance at 2.14 GHz on the graph 511*b* are 6.696259Ω and −0.369123Ω respectively. The real part and the imaginary part of the input impedance at 2.14 GHz on the graph 512*b* are 6.854880Ω and 0.020841Ω respectively. The real part and the imaginary part of the input impedance at 2.14 GHz on the graph 513*b* are 6.6998016Ω and 0.150937Ω respectively. The real part and the imaginary part of the input impedance at 2.14 GHz on the graph 514*b* are 8.132561Ω and −0.170008Ω respectively. The real part and the imaginary part of the input impedance at 2.14 GHz on the graph 515*b* are 11.071769Ω and −0.309638Ω respectively. The real part and the imaginary part of the input impedance at 2.14 GHz on the graph 516*b* are 20.644352Ω and −0.103293Ω respectively. The real part and the imaginary part of the input impedance at 2.14 GHz on the graph 517*b* are 50.069075Ω and −0.717366Ω respectively. The real part and the imaginary part of the input impedance at 2.14 GHz on the graph 518*b* are 153.526092Ω and −0.383727Ω respectively.

Figure 25:
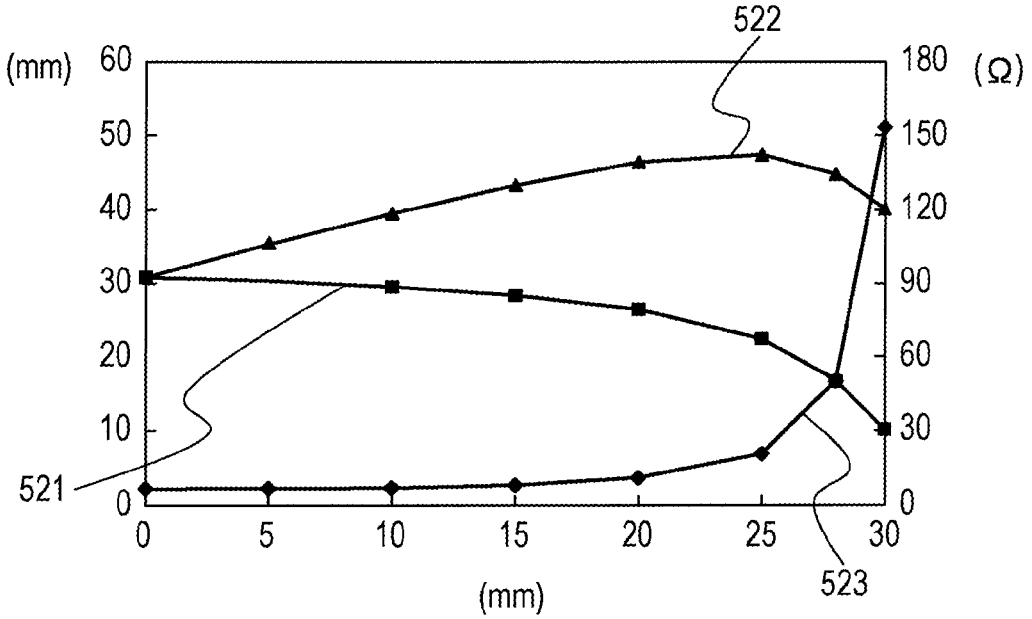
FIG. 25 is a diagram illustrating a relationship among a length of antenna, a depth of slot, and an input impedance.

FIG. 25 is a diagram illustrating a relationship among the length of antenna, the depth of slot, and the input impedance. In FIG. 25, the vertical axis on the left side of the page indicates the length. The vertical axis on the right side of the page indicates the real part of the input impedance. The horizontal axis indicates the depth of the slot. A graph 521 represents the length of the antenna. A graph 522 represents the length obtained by adding the length of the antenna to the depth of the slot. A graph 523 represents the real part of the input impedance.

As illustrated in FIG. 25, the real part of the input impedance rapidly increases from a point where the length of the slot is λ/10 (nearly equal to 14 mm). In other words, when the length of the slot is set to larger than or equal to λ/10, the real part of the input impedance may be increased.

When the original radiation resistance (the real part of the input impedance) is low, the depth of the slot has to be longer to obtain a matching condition. Specifically, the depth of the slot to be used varies depending on the radiation resistance of the antenna device, so that it may be possible to obtain a matching condition even when the length of the slot is λ/10.

In an antenna device, such as the antenna device 500 illustrated in FIG. 22, in which a substrate metal includes a linear slot having an opening near the end of the substrate metal and an inverted-L antenna is provided near the tip of a peninsula section, it is preferable that the length of the slot is set to an appropriate value greater than or equal to λ/10.

As described above, in an antenna device in which a substrate metal includes a linear slot having an opening near the end of the substrate metal and an inverted-L antenna is provided near the tip of a peninsula section, when the length of the slot is set to an appropriate value greater than or equal to λ/10, a good matching condition may be secured.

Fifth Embodiment

Figure 26:
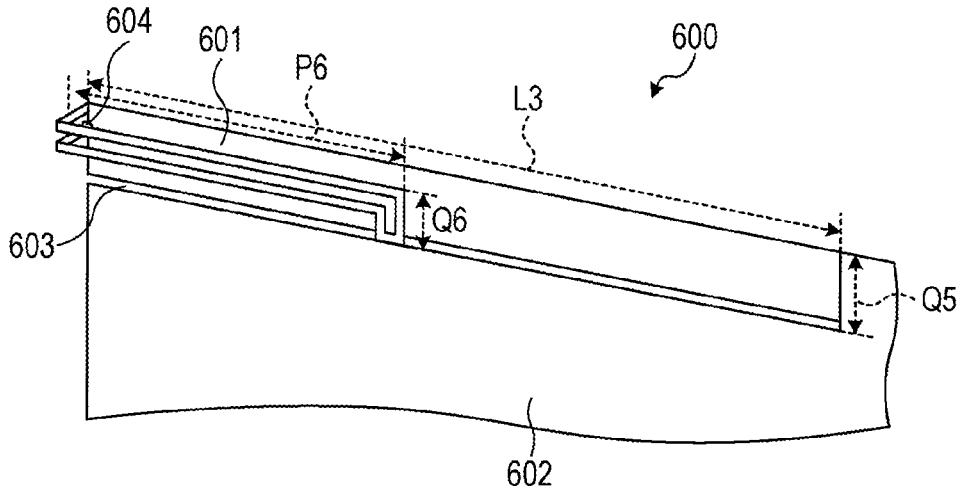
FIG. 26 is a perspective view of an antenna device according to a fifth embodiment.

Next, an antenna device according to a fifth embodiment will be described with reference to FIG. 26. FIG. 26 is a perspective view of the antenna device according to the fifth embodiment.

An antenna device 600 includes a slot 603 having an opening near the end of a substrate metal 602. The slot 603 has a linear shape. The length of the short side Q5 of the placing area is 4.0 mm. The length of the long side of the placing area, that is, the length of the slot, is defined as L3.

An antenna 601 is a folded inverted-L antenna. One end of the antenna 601 is connected to the substrate metal 602 through a feeding point 604. The length P6 is 17.5 mm. The width Q6 is 3.5 mm. The height of the antenna 601 from the substrate metal 602 is 1.0 mm.

Figure 27:
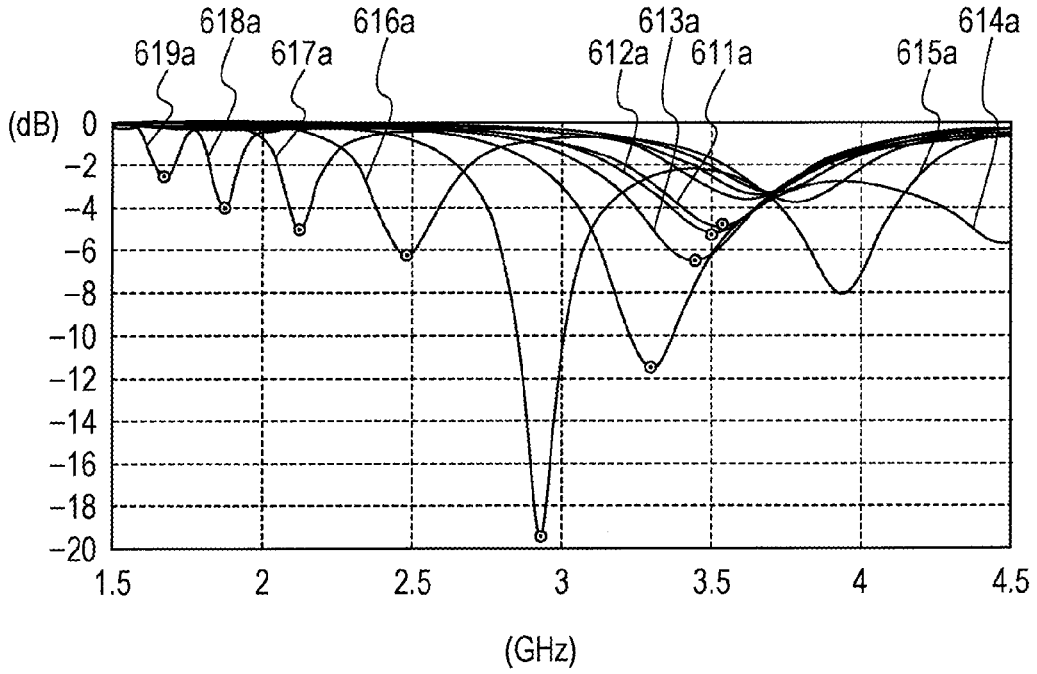
FIG. 27 is a diagram illustrating resonant frequencies when a slot length L3 is changed.

FIG. 27 is a diagram illustrating the resonant frequencies when L3 is changed. A graph 611*a* represents the reflection coefficient for each frequency in the case of L=0. A graph 612*a* represents the reflection coefficient for each frequency in the case of L=5. A graph 613*a* represents the reflection coefficient for each frequency in the case of L=10. A graph 614*a* represents the reflection coefficient for each frequency in the case of L=15. A graph 615*a* represents the reflection coefficient for each frequency in the case of L=20. A graph 616*a* represents the reflection coefficient for each frequency in the case of L=25. A graph 617*a* represents the reflection coefficient for each frequency in the case of L=30. A graph 618*a* represents the reflection coefficient for each frequency in the case of L=35. A graph 619*a* represents the reflection coefficient for each frequency in the case of L=40.

Figure 28:
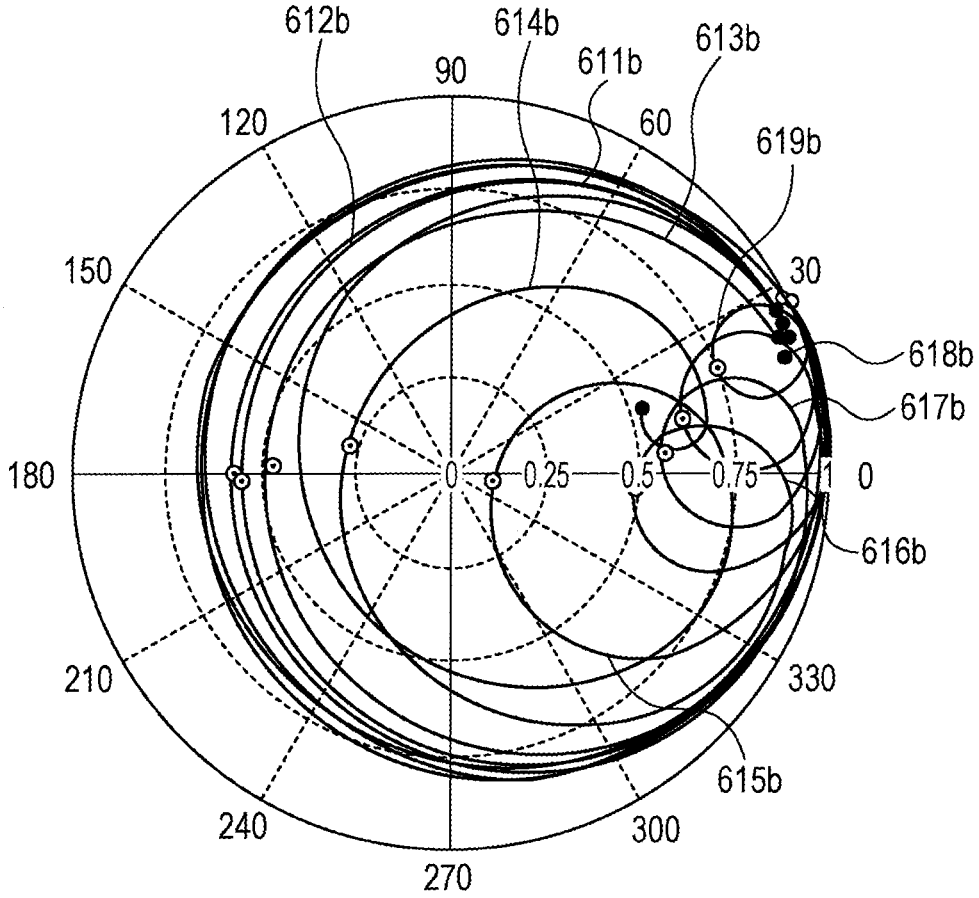
FIG. 28 is a Smith chart corresponding to FIG. 27.

FIG. 28 is a Smith chart corresponding to a case in which L3 is changed in FIG. 27. Specifically, a graph 611*b* represents the input impedance for each frequency in the case of L3=0. A graph 612*b* represents the input impedance for each frequency in the case of L3=5. A graph 613*b* represents the input impedance for each frequency in the case of L3=10. A graph 614*b* represents the input impedance for each frequency in the case of L3=15. A graph 615*b* represents the input impedance for each frequency in the case of L3=20. A graph 616*b* represents the input impedance for each frequency in the case of L3=25. A graph 617*b* represents the input impedance for each frequency in the case of L3=30. A graph 618*b* represents the input impedance for each frequency in the case of L3=35. A graph 619*b* represents the input impedance for each frequency in the case of L3=40. Points on the graphs represent the input impedances at the resonant frequency corresponding to each slot length obtained in FIG. 27.

As illustrated in FIG. 28, when the slot length is 10 mm or more, the matching condition is good. More specifically, when the slot length is 15 to 20 mm, the matching condition is more appropriate.

In this case, when standardizing the slot length and the input impedance by using that λ is nearly equal to 103.45 mm at 2.9 GHz, the real part of the input impedance begins to increase when the slot length exceeds about λ/10. Further, when the slot length is about (3/20)λ to (1/5)λ, the matching condition is more appropriate.

Therefore, in an antenna device in which a substrate metal includes a linear slot having an opening near the end of the substrate metal and a folded inverted-L antenna is provided near the tip of a peninsula section, when the length of the slot is set to an appropriate value greater than or equal to λ/10, a good matching condition may be secured.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a substrate;

a slot provided in the substrate so that the slot includes a cut opening that is close to an edge of the substrate and the slot includes a crooked portion;

a conductor section configured to include a slit in an area of the substrate, the area being sandwiched by the slot in the crooked portion; and an antenna that is placed close to the conductor section and is side by side with a surface of the substrate so that the antenna and the conductor section are provided so as to oppose to each other, an end of the antenna being coupled to a tip of the conductor section via a feeding point.

2. The antenna device according to claim 1, wherein the conductor section is formed by making a slit in a smaller area of two areas of the substrate, the areas being sandwiched by the slot.

3. The antenna device according to claim 1, wherein the slot includes a meander shape.

4. The antenna device according to claim 1, wherein the conductor section includes a meander shape.

5. The antenna device according to claim 1, wherein the antenna forms a folded inverted-L antenna.

6. The antenna device according to claim 1, further comprising:

a dielectric material including a plate shape, wherein the substrate is placed on one surface of the dielectric material, and the antenna extends from a point at which the antenna is connected to the substrate and further extends to come into contact with the other surface of the dielectric material.

7. The antenna device according to claim 6, wherein the antenna device is covered with the dielectric material.

8. The antenna device according to claim 6, wherein the antenna is an inverted-L antenna and is a folded inverted-L antenna that extends from two points connected to the substrate and further extends to come into contact with the other surface of the dielectric material and to be connected together.

9. The antenna device according to claim 1, further comprising:

a dielectric material including a plate shape, wherein the substrate is placed on one surface of the dielectric material, and the antenna extends to come into contact with the other surface of the dielectric material and the antenna is connected with the conductor section through a via which is formed in the dielectric material.

10. The antenna device according to claim 9, wherein the antenna device is covered with the dielectric material.

11. The antenna device according to claim 9, wherein the antenna is an inverted-L antenna and is a folded inverted-L antenna that extends from two points connected to the substrate and further extends to come into contact with the other surface of the dielectric material and to be connected together.

12. A mobile phone comprising:

an antenna unit configured to include, a substrate, a slot provided in the substrate so that the slot includes a cut opening that is close to an edge of the substrate and includes a crooked portion, a conductor section configured to include a slit in an area of the substrate, the area being sandwiched by the slot, and an antenna that is placed close to a tip of the conductor section and is side by side with a surface of the substrate so that the antenna and the conductor section are provided so as to oppose to each other, an end of the antenna being coupled to a tip of the conductor section via a feeding point;

a wireless communication unit configured to transmit and receive a wireless signal through the antenna unit; and a signal processing unit configured to process a signal received by the wireless communication unit and a signal to be transmitted from the wireless communication unit.

13. An antenna device comprising:

a substrate;

a slot which is provided in the substrate so that the slot includes a cut opening that is close to an edge near of the substrate and includes a length greater than or equal to one-tenth of a wavelength of a resonant frequency, the substrate being divided into a first area and a second area by the slot, the first area being smaller than the second area;

a feeding point placed within a distance of one-tenth of the wavelength of the resonant frequency from a portion close to a tip of the first area of the substrate, the first area being sandwiched by the slot; and an antenna which is connected to the first area of the substrate through the feeding point and is side by side with a surface of the substrate so that the antenna and the substrate are provided parallel to each other so as to oppose to each other, an end at a tip of the antenna being connected to the feeding point.

14. The antenna device according to claim 13, wherein the antenna is provided over the first area of the substrate.

* * * * *